US011083237B2

(12) United States Patent
Kelly et al.

(10) Patent No.: US 11,083,237 B2
(45) **Date of Patent: *Aug. 10, 2021**

(54) IMPACT ABSORBING APPARATUS

(71) Applicant: Windpact, Inc., Leesburg, VA (US)

(72) Inventors: Maurice A. Kelly, Leesburg, VA (US); Shawn A. Springs, Leesburg, VA (US); Leon A. Marucchi, Springfield, VA (US); Marcus A. Hadley, Gaithersburg, MD (US); Robert A. Carlton, Arlington, VA (US)

(73) Assignee: Windpact, Inc., Reston, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/056,058

(22) Filed: Aug. 6, 2018

(65) Prior Publication Data

US 2019/0208853 A1 Jul. 11, 2019

Related U.S. Application Data

(63) Continuation of application No. 14/516,107, filed on Oct. 16, 2014, now Pat. No. 10,039,338, which is a continuation of application No. 14/173,548, filed on Feb. 5, 2014, now Pat. No. 8,863,320, which is a continuation of application No. PCT/US2014/012257, filed on Jan. 21, 2014.

(60) Provisional application No. 61/547,254, filed on Oct. 14, 2011.

(51) Int. Cl.

| | |
|---|---|
| ***A63B 60/54*** | (2015.01) |
| ***A63B 71/10*** | (2006.01) |
| ***A42B 3/12*** | (2006.01) |

(52) U.S. Cl.
CPC ..... *A42B 3/122* (2013.01); *A42B 3/121* (2013.01); *A63B 60/54* (2015.10); *A63B 71/10* (2013.01)

(58) Field of Classification Search
CPC ..... A42B 3/121; A42B 3/122; A63B 60/54; A41D 13/015
USPC ..... 2/410–414, 455, 2.5, 6.8; 428/68, 76, 98
See application file for complete search history.

(56) References Cited

U.S. PATENT DOCUMENTS

| | | | |
|---|---|---|---|
| 1,348,950 | A | 8/1920 | Kaminski |
| 3,248,738 | A | 5/1966 | Morgan |
| 3,600,714 | A | 8/1971 | Cade |
| 3,713,640 | A | 1/1973 | Margan |

(Continued)

OTHER PUBLICATIONS

International Search Report and Written Opinion for International Patent Application No. PCT/US2014/012257, dated May 12, 2014.

(Continued)

*Primary Examiner* — Katherine M Moran
(74) *Attorney, Agent, or Firm* — Cooley LLP

(57) ABSTRACT

Some embodiments described herein relate to an athletic helmet. The athletic helmet can include a shell, a suspension chassis, and several impact-absorbing pads. The suspension chassis can be disposed within the shell and configured to couple the pads to the shell. Each pad can include a membrane defining an interior volume. A valve can place the interior volume in fluid communication with the exterior of the membrane. In some embodiments, two or more structural members can be disposed within the interior volume. One structural member can be at least partially deformed when the athletic helmet is worn by a user.

16 Claims, 17 Drawing Sheets

(56) References Cited

U.S. PATENT DOCUMENTS

| | | | | |
|---|---|---|---|---|
| 3,849,801 | A | 11/1974 | Holt et al. | |
| 3,882,547 | A * | 5/1975 | Morgan | A42B 3/121 2/414 |
| 3,994,021 | A | 11/1976 | Villari | |
| 4,086,664 | A | 5/1978 | Humphrey et al. | |
| D249,397 | S | 9/1978 | Humphrey et al. | |
| 4,287,613 | A | 9/1981 | Schulz | |
| 4,354,284 | A | 10/1982 | Gooding | |
| 4,566,137 | A | 1/1986 | Gooding | |
| 4,627,114 | A | 12/1986 | Mitchell | |
| 4,633,531 | A | 1/1987 | Nimmons | |
| 4,646,368 | A | 3/1987 | Infusino et al. | |
| D289,568 | S | 4/1987 | Nimmons | |
| D289,569 | S | 4/1987 | Nimmons | |
| 4,831,668 | A | 5/1989 | Schulz | |
| 4,991,230 | A * | 2/1991 | Vacanti | A41D 13/015 128/846 |
| 5,035,009 | A | 7/1991 | Wingo, Jr. et al. | |
| 5,168,576 | A * | 12/1992 | Krent | A41D 13/0156 2/456 |
| 5,175,889 | A | 1/1993 | Infusino | |
| 5,263,203 | A | 11/1993 | Kraemer et al. | |
| 5,404,590 | A | 4/1995 | Monica, Jr. | |
| D358,686 | S | 5/1995 | Kraemer | |
| 5,713,082 | A | 2/1998 | Bassette et al. | |
| 5,794,274 | A | 8/1998 | Kraemer | |
| 6,081,932 | A | 7/2000 | Kraemer | |
| 6,093,468 | A | 7/2000 | Toms et al. | |
| 6,240,571 | B1 | 6/2001 | Infusino | |
| 6,282,724 | B1 | 9/2001 | Abraham et al. | |
| 6,314,586 | B1 | 11/2001 | Duguid | |
| D465,067 | S | 10/2002 | Ide et al. | |
| D475,486 | S | 6/2003 | Ide et al. | |
| D492,818 | S | 7/2004 | Ide et al. | |
| 6,826,509 | B2 | 11/2004 | Crisco, III et al. | |
| 6,871,525 | B2 | 3/2005 | Withnall et al. | |
| 6,934,971 | B2 | 8/2005 | Ide et al. | |
| D511,026 | S | 10/2005 | Ide et al. | |
| D521,191 | S | 5/2006 | Berger | |
| 7,036,151 | B2 | 5/2006 | Ide et al. | |
| 7,089,602 | B2 | 8/2006 | Talluri | |
| D528,705 | S | 9/2006 | Ide et al. | |
| 7,146,652 | B2 | 12/2006 | Ide et al. | |
| 7,234,771 | B2 | 6/2007 | Nakhla | |
| 7,240,376 | B2 | 7/2007 | Ide et al. | |
| D570,055 | S | 5/2008 | Ferrara | |
| D581,599 | S | 11/2008 | Ferrara | |
| D582,607 | S | 12/2008 | Ferrara | |
| D584,456 | S | 1/2009 | Ferrara | |
| 7,526,389 | B2 | 4/2009 | Greenwald et al. | |
| 7,547,079 | B2 | 6/2009 | Choi | |
| D603,099 | S | 10/2009 | Bologna et al. | |
| D603,100 | S | 10/2009 | Bologna | |
| D603,103 | S | 10/2009 | Ferrara | |
| D608,688 | S | 1/2010 | Dalzell et al. | |
| 7,744,154 | B2 | 6/2010 | Marsden et al. | |
| 7,774,866 | B2 | 8/2010 | Ferrara | |
| 7,850,234 | B2 | 12/2010 | Marsden et al. | |
| 7,895,681 | B2 | 3/2011 | Ferrara | |
| 7,900,279 | B2 | 3/2011 | Kraemer et al. | |
| 7,959,223 | B2 | 6/2011 | Marsden et al. | |
| 8,029,054 | B2 | 10/2011 | Marsden et al. | |
| 8,038,209 | B2 | 10/2011 | Marsden et al. | |
| 8,052,210 | B2 | 11/2011 | Marsden et al. | |
| 8,056,971 | B2 | 11/2011 | Marsden et al. | |
| 8,056,972 | B2 | 11/2011 | Marsden et al. | |
| 8,061,768 | B2 | 11/2011 | Amirault et al. | |
| 8,104,829 | B2 | 1/2012 | Fritz et al. | |
| 8,128,165 | B2 | 3/2012 | Marsden et al. | |
| 8,336,122 | B1 | 12/2012 | Harris | |
| 8,528,119 | B2 | 9/2013 | Ferrara | |
| 8,863,320 | B2 * | 10/2014 | Kelly | A42B 3/122 2/413 |
| 10,039,338 | B2 * | 8/2018 | Kelly | A42B 3/122 |
| 2004/0226077 | A1 | 11/2004 | Toth et al. | |
| 2005/0177335 | A1 | 8/2005 | Crisco, III et al. | |
| 2006/0059605 | A1 | 3/2006 | Ferrara | |
| 2006/0059606 | A1 | 3/2006 | Ferrara | |
| 2007/0190293 | A1 | 8/2007 | Ferrara | |
| 2008/0155735 | A1 | 7/2008 | Ferrara | |
| 2008/0256686 | A1 | 10/2008 | Ferrara | |
| 2009/0038055 | A1 | 2/2009 | Ferrara | |
| 2009/0179469 | A1 | 7/2009 | Bass | |
| 2009/0224580 | A1 | 9/2009 | Fritz et al. | |
| 2009/0233511 | A1 * | 9/2009 | Turner | B32B 5/024 442/373 |
| 2009/0289026 | A1 | 11/2009 | Ferrara | |
| 2010/0026059 | A1 | 2/2010 | Amirault et al. | |
| 2010/0026064 | A1 | 2/2010 | Marsden et al. | |
| 2010/0186150 | A1 | 7/2010 | Ferrara | |
| 2010/0282554 | A1 | 11/2010 | Stone | |
| 2010/0295270 | A1 | 11/2010 | Marsden et al. | |
| 2010/0295341 | A1 | 11/2010 | Marsden et al. | |
| 2010/0295342 | A1 | 11/2010 | Marsden et al. | |
| 2010/0295343 | A1 | 11/2010 | Marsden et al. | |
| 2010/0295344 | A1 | 11/2010 | Marsden et al. | |
| 2010/0295345 | A1 | 11/2010 | Marsden et al. | |
| 2010/0295346 | A1 | 11/2010 | Marsden et al. | |
| 2010/0295347 | A1 | 11/2010 | Marsden et al. | |
| 2011/0047685 | A1 | 3/2011 | Ferrara | |
| 2011/0171420 | A1 | 7/2011 | Yang | |
| 2013/0142985 | A1 | 6/2013 | Yang | |
| 2014/0201890 | A1 | 7/2014 | Kelly et al. | |
| 2015/0033454 | A1 | 2/2015 | Kelly et al. | |

OTHER PUBLICATIONS

European Search Report issued by the European Patent Office for Application No. 14740156.6, dated Mar. 29, 2017, 14 pages.

Non-Final Office Action issued by The United States Patent and Trademark Office for U.S. Appl. No. 14/516,107, dated Sep. 15, 2016, 14 pages.

Non-Final Office Action issued by The United States Patent and Trademark Office for U.S. Appl. No. 14/516,107, dated Mar. 15, 2017, 19 pages.

Final Office Action issued by The United States Patent and Trademark Office for U.S. Appl. No. 14/516,107, dated Sep. 21, 2017, 18 pages.

Notification of First Office Action for Chinese Application No. 201480016436.8, dated Jul. 5, 2017, 17 pages.

Communication Pursuant to Article 94(3) issued by the European Patent Office for Application No. 14740156.6, dated Sep. 17, 2018, 5 pages.

Notification of Third Office Action for Chinese Application No. 201480016436.8, dated Nov. 15, 2018, 7 pages including English translation.

Notification of Fourth Office Action for Chinese Application No. 201480016436.8, dated Jun. 12, 2019, 15 pages including English translation.

Office Action issued by the Canadian Patent Office for Application No. 2,936,088, dated Nov. 27, 2019, 4 pages.

Summons to Attend Oral Hearing issued by the European Patent Office for Application No. 14740156.6, dated Nov. 8, 2019, 5 pages.

Office Action issued by the Brazilian Patent Office for Application No. BR112015016922-8, dated Jan. 14, 2020, 5 pages including one page Informal English translation.

Office Action for Chinese Application No. 201480016436.8, dated Mar. 4, 2020, 15 pages including English translation.

Office Action issued by the Canadian Patent Office for Application No. 2,936,088, dated Jul. 22, 2020, 3 pages.

* cited by examiner

IMPACT ABSORBING APPARATUS

CROSS REFERENCE TO RELATED APPLICATION

This application is a continuation of U.S. patent application Ser. No. 14/516,107, filed Oct. 16, 2014, which is a continuation of U.S. patent application Ser. No. 14/173,548, filed Feb. 5, 2014, now U.S. Pat. No. 8,863,320, which is a continuation of International Application No. PCT/US14/12257, filed Jan. 21, 2014, which claims priority to and the benefit of U.S. Provisional Application No. 61/754,254, filed Jan. 18, 2013, each entitled "Impact Absorbing Apparatus," the disclosures of each of which are incorporated herein by reference in its entirety.

BACKGROUND

Some embodiments described herein relate to an impact absorbing apparatus. An impact absorbing apparatus can be a protective head device, such as an athletic helmet including impact absorbing pads.

Some known impact absorbing paddings include ethyl vinyl acetate (EVA) foam. Such known pads absorb energy through a single mode, deformation. As a result, pads designed to mitigate the transmission of forces and/or accelerations associated with a high-energy impact can provide inadequate energy absorption for lower energy impacts, i.e., the pad can be "hard." Conversely, a pad designed to mitigate the transmission of forces and/or accelerations associated with lower energy impacts can cease to be effective after exceeding their energy absorbing capacity, i.e., the pad can "bottom out."

Traditionally, athletic helmets, such as football helmets have been designed primarily to mitigate the effect of high-energy impacts with the potential to cause immediate injury, such as concussions. In general, the ability of an athletic helmet to mitigate lower energy impacts has traditionally been viewed as an incidental benefit, and, as such, relatively little attention has been paid to the effectiveness of athletic helmets and impact absorbing paddings to mitigate routine lower energy impacts. The traditional view has been that if a wearer is able to walk away from a routine lower energy impact without suffering immediate injury, the athletic helmet has accomplished its purpose. Recent research, however, has suggested that the relatively lower energy impacts may contribute to long-term neurological problems such as chronic traumatic encephalopathy (CTE).

Accordingly, a need exists for an impact absorbing pad and a protective head device that can operate in different and/or synergistic modes for high-energy impact absorption and low-energy impact absorption. For example, a need exists for a football helmet suitable to more effectively absorb routine lower energy football-related impacts as well as more serious high-energy impacts, such as impacts having a potential to cause immediate injury.

SUMMARY

Figure 1:
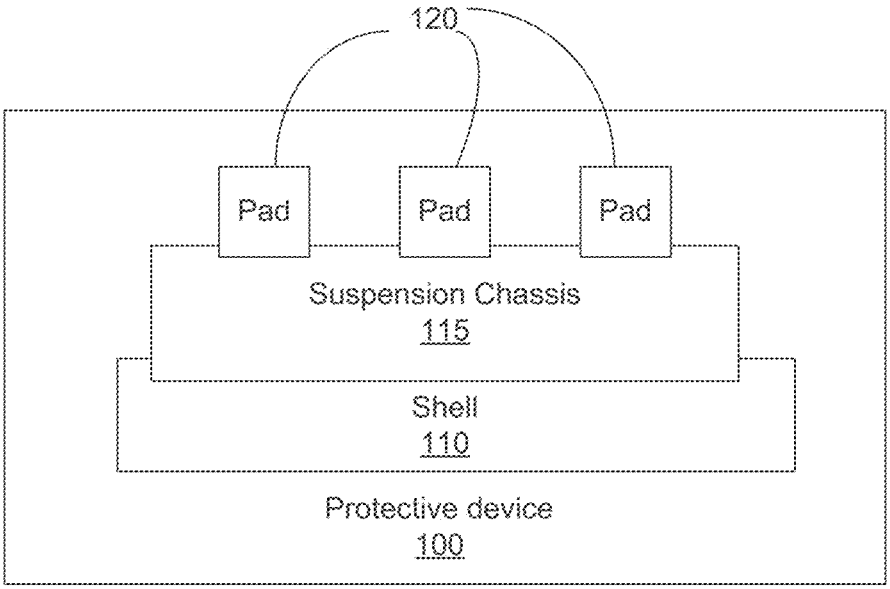
FIG. 1 is a schematic diagram illustrating a protective device, according to an embodiment.

Some embodiments described herein relate to an athletic helmet. The athletic helmet can include a shell, a suspension chassis, and several impact-absorbing pads. The suspension chassis can be disposed within the shell and configured to couple the pads to the shell. Each pad can include a membrane defining an interior volume. A valve can place the interior volume in fluid communication with the exterior of the membrane. In some embodiments, two or more structural members can be disposed within the interior volume. One structural member can be at least partially deformed when the athletic helmet is worn by a user.

DETAILED DESCRIPTION

In some embodiments an athletic helmet can include a shell, a suspension chassis, and several impact-absorbing pads. The suspension chassis can be disposed within the shell and configured to couple the pads to the shell. A pad can include a membrane defining an interior volume. In some embodiments, two or more structural members can be disposed within the interior volume. One structural member can be at least partially deformed when the athletic helmet is worn by a user. When a force is applied to the pad, the structural members can deform, and the interior volume can decrease. A valve can place the interior volume in fluid communication with the exterior of the membrane. In some embodiments, the valve can restrict the flow of fluid (such as air) from the interior volume to the exterior, which can decrease the rate at which the pad deforms.

In some embodiments an athletic helmet can include a shell, a suspension chassis, and several impact-absorbing pads. A pad can include an outer membrane and a bisecting membrane that can collectively define two interior volumes. A structural member can be disposed within each interior volume, and a valve can place at least one of the interior volumes in fluid communication with an exterior of the pad. The suspension chassis can couple at least one pad to the shell. The suspension chassis can be coupled to a middle portion of the pad, such that the end of the pad that is in contact with the shell can move relative to the shell.

In some embodiments, an athletic helmet can include a shell, a suspension chassis, and several impact-absorbing pads. A pad can include a membrane defining an interior volume. In some embodiments, the membrane may not be sufficiently rigid to define a predefined shape of the membrane. Similarly stated, the membrane can be a relatively thin film that lacks the structural strength to support its own weight. Two structural members can be disposed within the interior volume. The structural members can support the membrane and/or define the shape of the pad. A first structural member can be configured to be disposed adjacent the shell when the helmet is worn, and a second structural member can be configured to be disposed adjacent the head of a wearer when the helmet is worn. Similarly stated, the second structural member can be disposed between the head and the first structural member when the helmet is worn. In some embodiments, the second structural member can be softer than the first structural member. Similarly stated, the second structural member can have a lower elastic modulus, can be configured to exert a lower reaction force when the force is applied (e.g., the first structural member can have a greater indention force deflection as described in further detail herein), and/or can have a lower density than the first structural member. When a force is applied to the pad, at least one of the structural members can deform, which can cause the volume of the pad to decrease. A valve, which can place the interior volume in fluid communication with an exterior of the pad, can limit the rate of deformation, for example, by restricting rate at which fluid (e.g., air) leaves the interior volume when the pad is deformed.

FIG. 1 is a schematic diagram of a protective device, according to an embodiment. The protective device 100 can be, for example a helmet, such as a football helmet, a batting helmet, a hockey helmet, etc. The protective device 100 can be operable to mitigate impacts, for example by absorbing forces and/or accelerations associated with an impact. The protective device 100 can, for example, be operable to mitigate head and/or brain injuries, such as concussions, by absorbing impact forces and/or reducing impact-related acceleration. The protective device 100 can be operable to sustain and mitigate the risk of injury from repeated impacts, such as impacts that might occur during a contact sport, for example, resulting from collisions with other players or the ground.

The protective device 100 can include a shell 110, a suspension chassis 115, and one or more pads 120. The shell 110 can be a rigid structure operable to spread the force associated with an impact over a larger area. For example, the shell 110 can be operable to spread the impact to pads 120 not immediately adjacent to the impact site. The shell 110 can be constructed of, for example, polycarbonate or any other suitable material.

One or more pads 120 can be disposed within the shell 110. The pads 120 can be configured to be placed between the head of a user and the shell 110. As described in more detail herein, the pads 120 can be configured to deform upon receiving a force and/or impact. For example, the pads 120 can elastically, plastically, visco-elastically, and/or non-linearly deform when the helmet 100 is subject to an impact. When the pads 120 deform, the force and/or acceleration transmitted through the pads 120, for example, to the head of the user, can be reduced.

In some embodiments, the pads 120 can be rigidly coupled to the shell 110. In other embodiments, the pads 120 can be moveably coupled, such that the shell 110, the pads 120, and/or the user's head can move relative to each other when the protective device 100 sustains an impact. For example, the pads 120 can be coupled to the shell 110 via a suspension chassis 115 that can be operable to define a range of movement of the pads 120 within the shell 110 The suspension chassis 115 can prevent the pads 120 from falling out of the shell 110, but can allow the pads 120 to move a limited or predefined distance within the shell 110 for example by stretching and/or flexing. In this way, in some embodiments, when the protective device 110 is subjected to an impact, a portion of the impact energy can be dissipated by the movement of pads 120 relative to the shell 110. In some embodiments, the pads 120 and/or the suspension chassis 115 can be removeably coupled to the shell 110.

Figure 2:
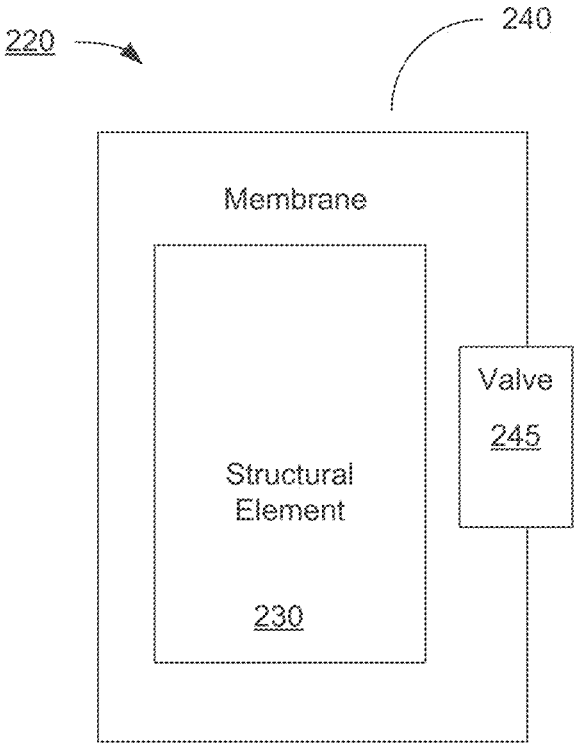
FIGS. 2, 3, and 3A are schematic diagrams that illustrate impact absorbing pads, according to various embodiments.

FIG. 2 is a schematic diagram of an impact absorbing pad, according to an embodiment. The pad 220 can be placed between the shell of a helmet and the head of a user. As shown, the pad 220 includes a structural element 230, a membrane 240, and a valve 245.

The structural element 230 can be an energy absorption material, such as an open-cell foam or a closed-cell foam. The structural element 230 can be constructed of foamed polyurethane, foamed rubber, expanded polypropylene (EPP), expanded polystyrene (EPS), ethylene vinyl acetate (EVA), memory foam, and/or any other suitable material. The structural element 230 can be constructed of, for example, Guirit® PVCell® G-Foam, such as G25, G60, G170, or G430; Wm. T. Burnett & Co. foam, such as G430 or FS170; Rubberlite HyPUR-cel T1515; Poron XRD-09500-65; and/or any other suitable foam. The structural element 230 can be configured to deform elastically, plastically, and/or visco-elastically when subject to a force thereby reducing peak forces and accelerations transmitted through the pad 220 during an impact. In some embodiments, the structural element 230 can be configured to return to its original shape and/or configuration when a force is removed within, for example, less than 90 seconds, less than 30 seconds, less than 5 seconds, less than 1 second, etc.

The structural element 230 can at least partially define the shape of the pad 220. The membrane 240 can substantially surround, envelop, and/or encase the structural element 230. The membrane 240 can have a size and/or shape similar to the structural element 230. In some embodiments, the membrane 240 is not coupled to the structural element 230. Similarly stated, the membrane 240 can be a closed bag containing the structural element 240. In some embodiments, the membrane 240 can be a flexible film, sheet, and/or cloth. The membrane 240 can be constructed of polyurethane, polyethelene, nylon, paper, cotton, and/or any other suitable material. The membrane 240 can have a thickness of less than 2 mm, less than 1 mm, less than 0.5 mm, and/or any other suitable thickness. In some embodiments, the membrane 240 does not have a structural strength or rigidity sufficient to define the shape of the pad 220. For example, the membrane 240 may not have sufficient structural strength to support its own weight. In such an embodiment, the membrane can conform or substantially conform to the shape of the pad 220.

The membrane 240 can define an interior volume. The structural element 230 can be disposed within the interior volume. The membrane 240 can be operable to prevent and/or impede air contained within the interior volume from exiting. Thus, the membrane 240 can define an air-cushion, such that a force applied to the pad 220 can be transmitted to the air contained within the interior volume.

The valve 245 can allow air to exit the internal volume, for example, when a force is applied to the pad 220. In some embodiments, the valve 245 can be an opening in the membrane 240, such as a vent, hole, flap, and/or perforation. In other embodiments, the valve 245 can be a porous portion of the membrane 240. In some embodiments, the valve 245 can be directional. For example, the valve 245 can apply a greater restriction to air flowing in one direction, such as air exiting the interior volume than air flowing in another direction, such as entering the interior volume.

In some embodiments, the valve 245 can be configured to limit the volume and/or rate of air exiting the internal volume. For example, when the pad 220 is subject to a force, air flowing within the membrane 240 can be impeded from exiting through the valve 245. For example, the valve 245 can be a small perforation relative to the volume of air contained within the membrane 240 such that a force applied to the pad 220 can produce laminar and/or turbulent flows within the membrane 240, inhibiting the air from flowing through the valve 245. In this way, the valve can limit the upper rate at which the force can transmitted from the membrane 240 to the structural element 230.

In some embodiments, the pad 220 can be configured such that the force transmitted through the pad is dependent on the magnitude of the force and/or the duration of the force. For example, the pad 220 can be configured such that a relatively low-energy impact, a relatively small force, and/or a force gradually applied over a relatively long period of time is absorbed and/or transmitted substantially entirely by the structural element 230. The valve 245 can be configured such that when a relatively small force is applied and/or when a force is gradually applied, the air contained in the interior volume can flow through the valve 245 relatively unimpeded as the structural element 230 is compressed. Similarly stated, when such a force is applied to the pad 220, the volume and/or shape of the pad 220 can change relatively gradually or slowly, and the characteristics of the structural element 230 can substantially govern or define the performance of the pad 220.

In some embodiments, when a force is applied to the pad 220 relatively suddenly, such as a relatively high-energy impact, the valve 245 can restrict the flow of air from the interior volume, thus resisting a sudden change in size and/or shape of the pad 220. Upon receiving such a force, both the structural element 230 and the air in the interior volume can resist changing shape and/or size, thereby absorbing energy. Similarly stated, upon receiving a relatively high-energy impact, the pressure of the air within the interior volume can increase, thereby absorbing energy from the impact. As the pressure increases, air can escape from the interior volume via the valve 245, the restricted flow further absorbing energy from the impact. Additionally, as air exits the interior volume, the structural element 230 can absorb energy through deformation. In some embodiments, the structural element 230 and resistance of flow can provide parallel energy absorbing modes. These parallel energy absorbing modes can provide the pad 220 with a non-linear response to impacts. For example, the restriction of flow provided by the valve 245 can provide greater resistance to rapid changes in shape and/or volume of the pad 220, while the structural element 230 can provide greater resistance to changes in shape and/or volume over a longer period of time than the membrane 240.

In some embodiments, such as, for example, embodiments in which the structural element 230 is an open-cell foam, the density, porosity, compressive strength, and/or other material properties of the structural element 230 can affect the rate at which the air pressure within the pad 220 changes. For example, if the structural element 230 has relatively large pore size, relatively low density, and/or relatively low compressive strength, the structural element 230 can be deformed relatively easily, thereby displacing air relatively quickly and increasing the pressure within the interior volume upon impact. In embodiments in which the structural element 230 can be relatively easily deformed, and/or during a relatively high-energy impact, the impact mitigation properties of the pad 220 can be largely determined by the flow-restricting characteristics of the valve 245. Conversely, in embodiments in which the structural element 230 is relatively difficult to deform, has a closed cell structure, and/or during a relatively low-energy impact, the structural element 230 can displace less air as it deforms, thereby absorbing a larger portion of the energy.

In some embodiments, the structural element 230, the size of the interior volume defined by the membrane 240, and the valve 245, collectively, can be configured to reduce the transmission of forces and/or acceleration across the pad 220 for particular impact characteristics. For example, in embodiments where the pad 220 is intended to form part of a helmet configured to mitigate the transmission of forces/impacts associated with playing football, the pad 220 can be configured to resist or reduce the transmission of concussion-causing accelerations.

In some embodiments, the force and/or acceleration absorption characteristics of the pad 220 can be primarily dependent on the structural element 230 for relatively low forces and/or accelerations, while the force and/or acceleration absorption characteristics for relatively high forces and/or accelerations can be primarily dependent on the exit of air from the inner volume through the valve 245.

In some embodiments, as described in more detail herein, the pad 220 can be configured to resist a particular range of forces and/or accelerations. The characteristics and/or configurations of the pad 220 can define how forces and/or accelerations are transmitted. For example, such characteristics can include or such configurations can be based on the volume of the interior region, the shape, size, and/or material properties of the structural element 230, and/or ability of the valve 245 to resist the flow of air. As a result, the pad 220 can be tuned to absorb particular forces and/or accelerations, for example, by decreasing peak acceleration and increasing the duration of the acceleration associated with an impact event. For example, in embodiments where the pad 220 is configured to be placed in a football helmet, the pad 220 can be configured to absorb impacts imparting peak accelerations of approximately 50-100 g. Similarly stated, when the pad 220 experiences an acceleration of approximately 50-100 g, the membrane 240 and the valve 245 can be operable to decrease the transmitted peak acceleration and/or increase the duration of the transmitted acceleration. For example, when the pad 220 experiences an acceleration of approximately 50-100 g, the upper rate at which air flows from the interior volume can be limited to reduce the maximum rate at which the pad 220 deforms. At higher accelerations, for example accelerations of approximately 500 g, the flow restriction induced by the valve 245 can cause the deformation of the pad 220 to be too slow to effectively absorb the energy of the impact. Accelerations of this magnitude, however, are unlikely to be experienced during a football game, and a pad 220 need not mitigate this type of acceleration. As described in further detail herein, in some embodiments, type and/or configuration of the pad can be preselected based on its location within a helmet. For example, a pad configured to be disposed on a crown of a helmet can be configured to mitigate higher energy impacts than a pad disposed on a side of the helmet.

Alternatively, when the pad 220 experiences a lower acceleration, such as accelerations of approximately 5 g, the valve 245 may not effectively restrict the flow of air from the pad. Similarly stated, at low accelerations, the rate of air flow can be too low for the valve 245 to effectively resist changes of volume of the pad 220. Such accelerations, however, may be unlikely to cause injury, and thus little need exists for a pad to mitigate such accelerations. Alternatively, in some embodiments, the structural element 230 of the pad can adequately mitigate low-acceleration impacts.

Figure 3:
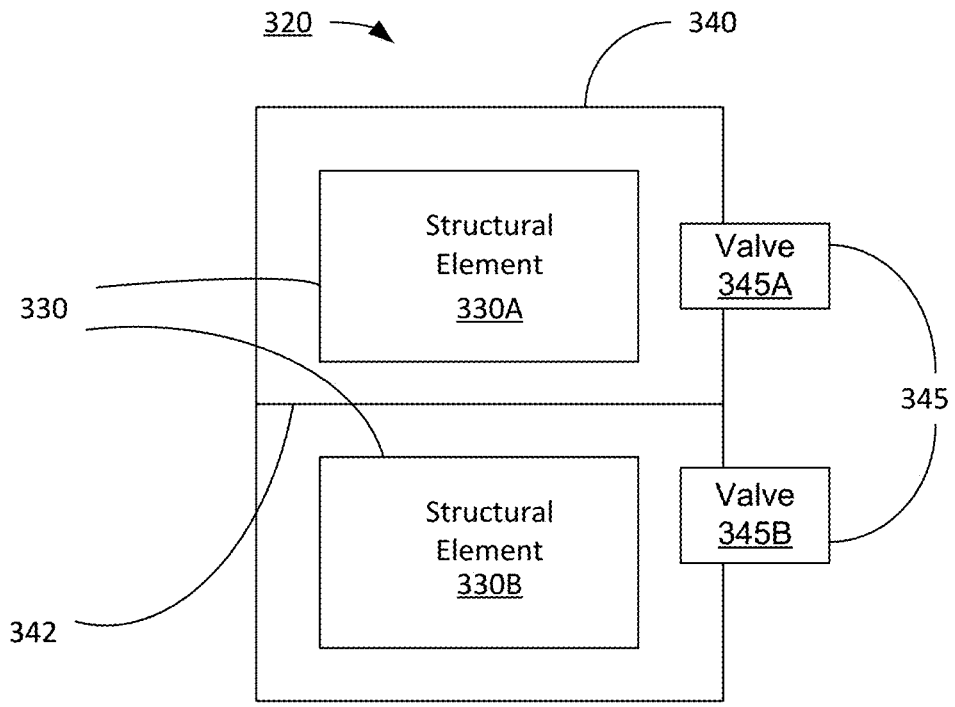

FIG. 3 is a schematic diagram of an impact absorbing pad, according to an embodiment. The pad 320 can be placed between the shell of a helmet and the head of a user. As shown, the pad 320 includes structural elements 330, a membrane 340, a bisecting membrane 342 (also referred to herein as an interior membrane), and valves 345.

Figure 3A:
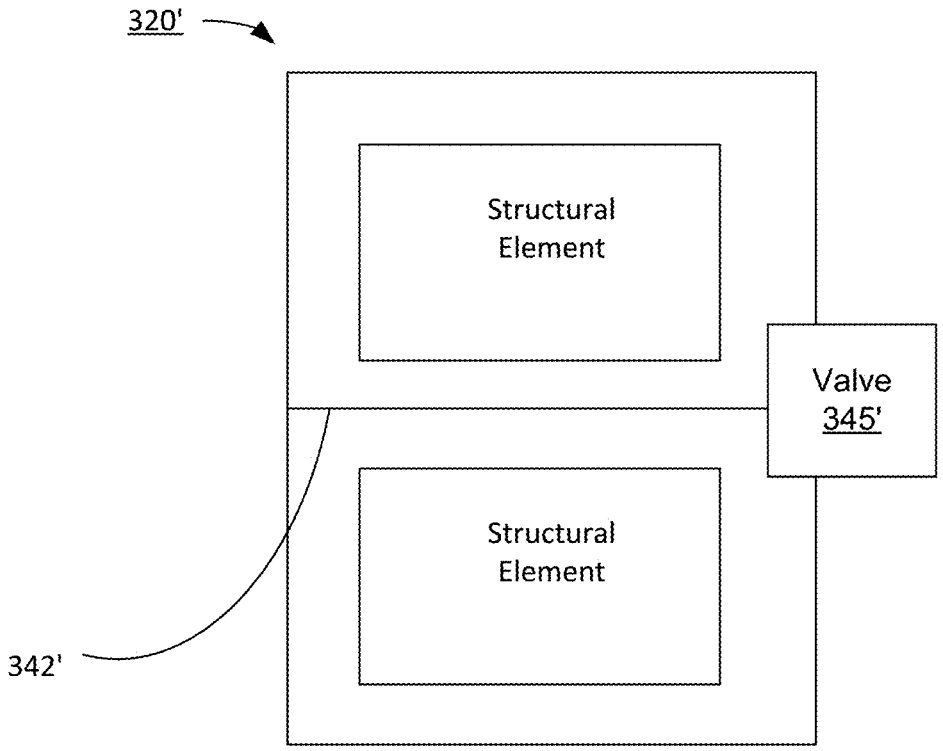

The pad 320 can be functionally similar to the pad 220 of FIG. 2. Each of the structural elements 330, the membrane 320, and the valves 345 can be structurally and/or functionally similar to the structural element 230, the membrane 220, and the valve 245, respectively, as shown and described above with reference to FIG. 2. The bisecting membrane 342 can divide the pad 330 into two chambers, each containing a structural element 330 and a valve 345 (in other embodiments, for example, as shown in FIG. 3A, a single valve 345' disposed adjacent to, on, or across the bisecting membrane 342 can place both chambers in fluid communication with an exterior of the pad 320). The bisecting membrane 342 can prevent air from flowing from the chamber containing structural element 330A to the chamber containing structural element 330B. The bisecting membrane 342 can be constructed of materials suitable for the construction of the membrane 330.

In some embodiments, the chambers defined by the membrane 340 and the structural element 330 can be symmetric, i.e., they can be substantially the same size and shape, contain similar structural elements 330 and similar valves 345. In other embodiments, the chambers can be asymmetrical. For example, the structural element 330A can be a different size and/or shape than the structural element 330B, the structural element 330A can be constructed from a different material than the structural element 330B, and/or the valve 345A can have different flow restricting properties than the valve 345B.

In some asymmetrical embodiments, the pad 320 can be configured to absorb force and/or acceleration over a greater range of forces and/or accelerations than the pad 220 of FIG. 2 of a similar overall size and/or shape. For example, the chamber containing structural element 330A can have a larger volume than the chamber containing structural element 330B and/or valve 345A can have greater flow restricting properties than the valve 345B. Thus, the chamber containing structural element 330A can be optimized to absorb higher forces and/or accelerations, the chamber containing structural element 345B can be optimized to absorb lower forces and/or accelerations, and collectively the two-chamber structure can absorb impacts over a greater range of forces and/or accelerations.

The pad 320 can be configured to receive a force such that the chamber containing structural element 330A and the chamber containing structural element 330B are deformed in series or in parallel. Although shown with one bisecting membrane 342 defining two chambers, in other embodiments any number of membranes can define any number of chambers. Similarly, although shown with a membrane 340 and a bisecting membrane 342, in other embodiments, the pad 320 can be formed by coupling a first membrane, substantially enclosing a first structural element to a second membrane, substantially enclosing a second structural element.

FIGS. 4A-4J, 5-7, and 8A and 8B are impact absorbing pads, according to various embodiments. The pads 420, 520, 620, 720, and 820 can be structurally and/or functionally similar to the pad 320 as shown and described above with reference to FIG. 3.

Figure 4A:
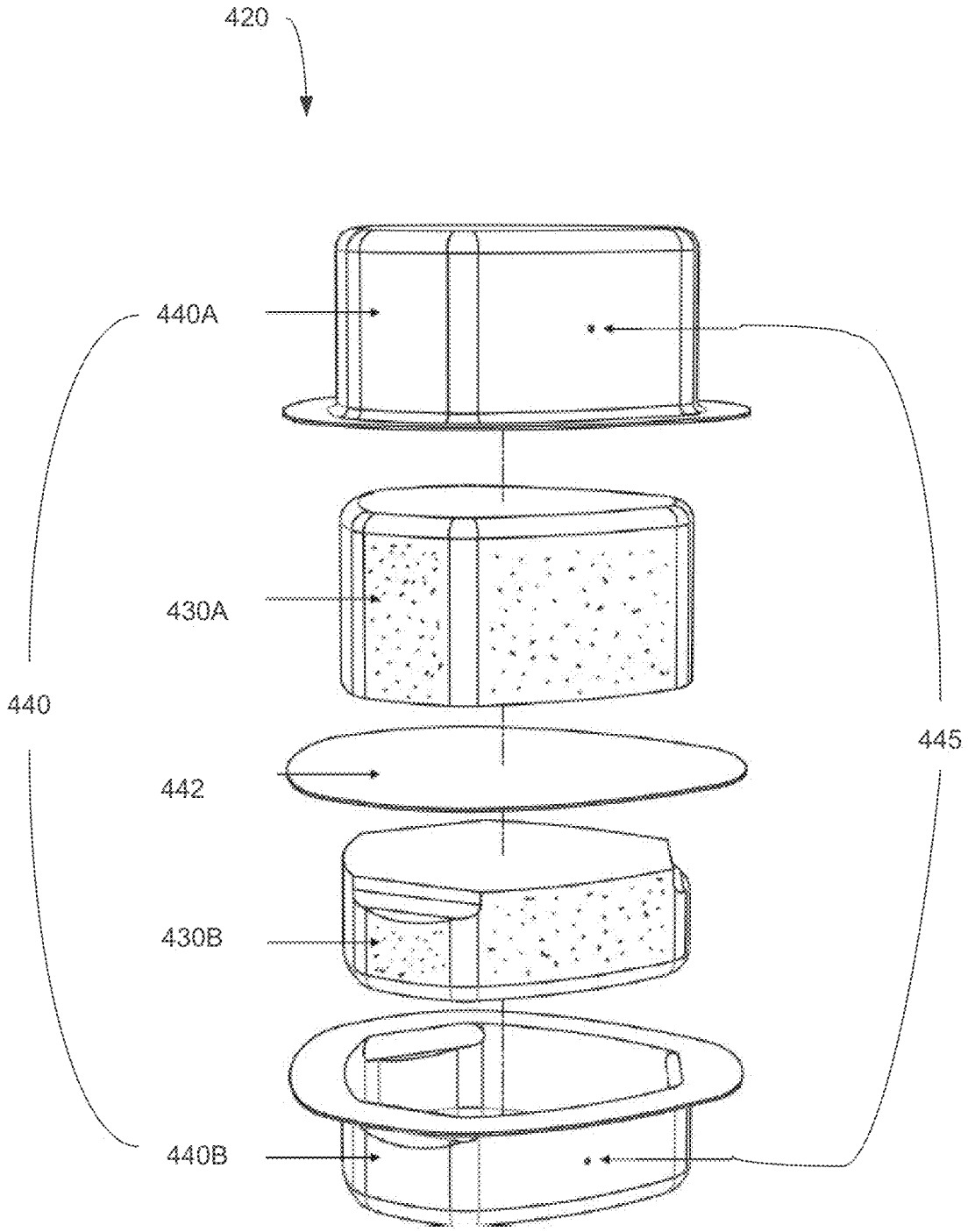
FIGS. 4A and 4B are exploded views of an impact absorbing pad, according to an embodiment.
Figure 4B:
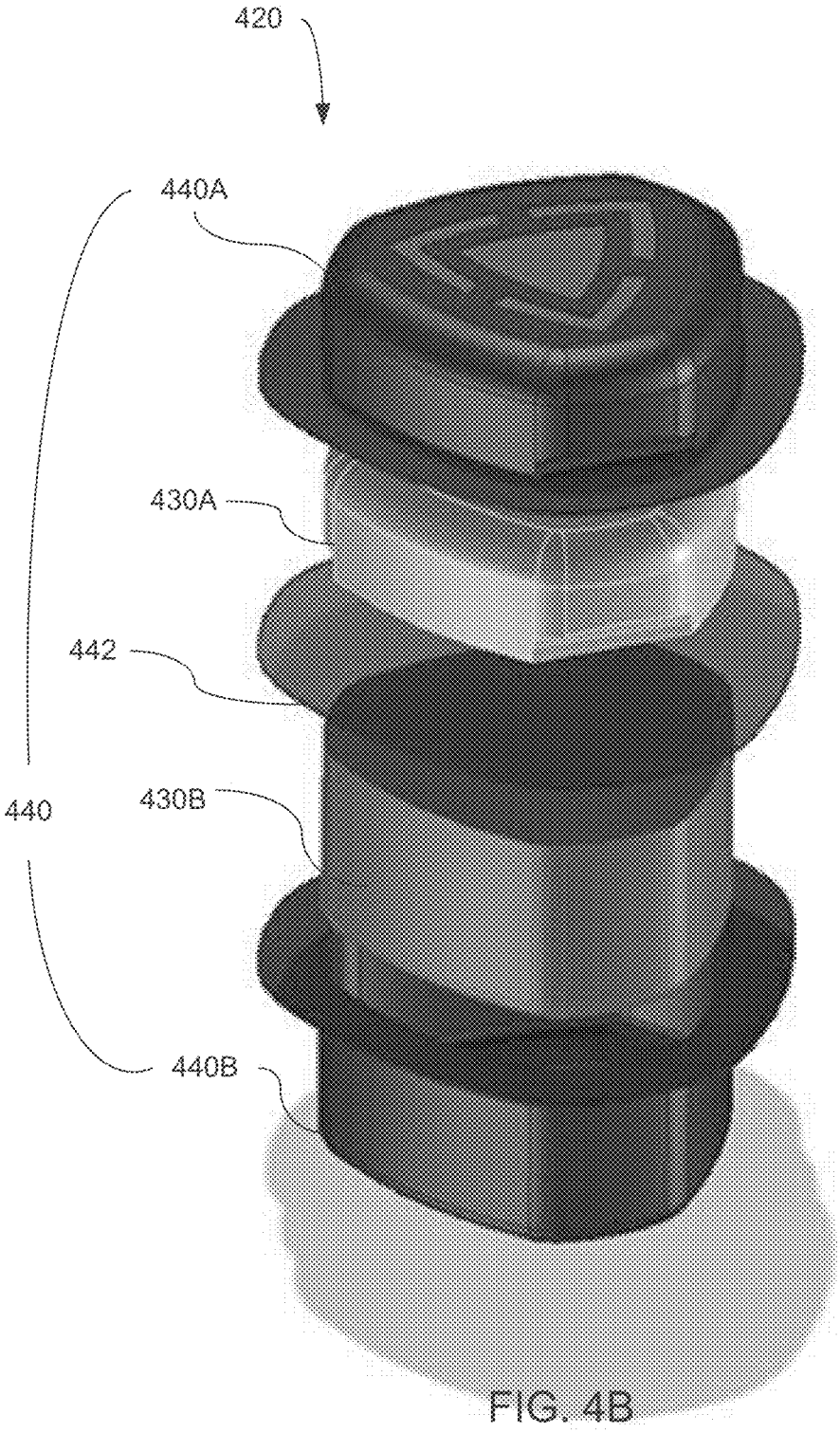
Figure 4C:
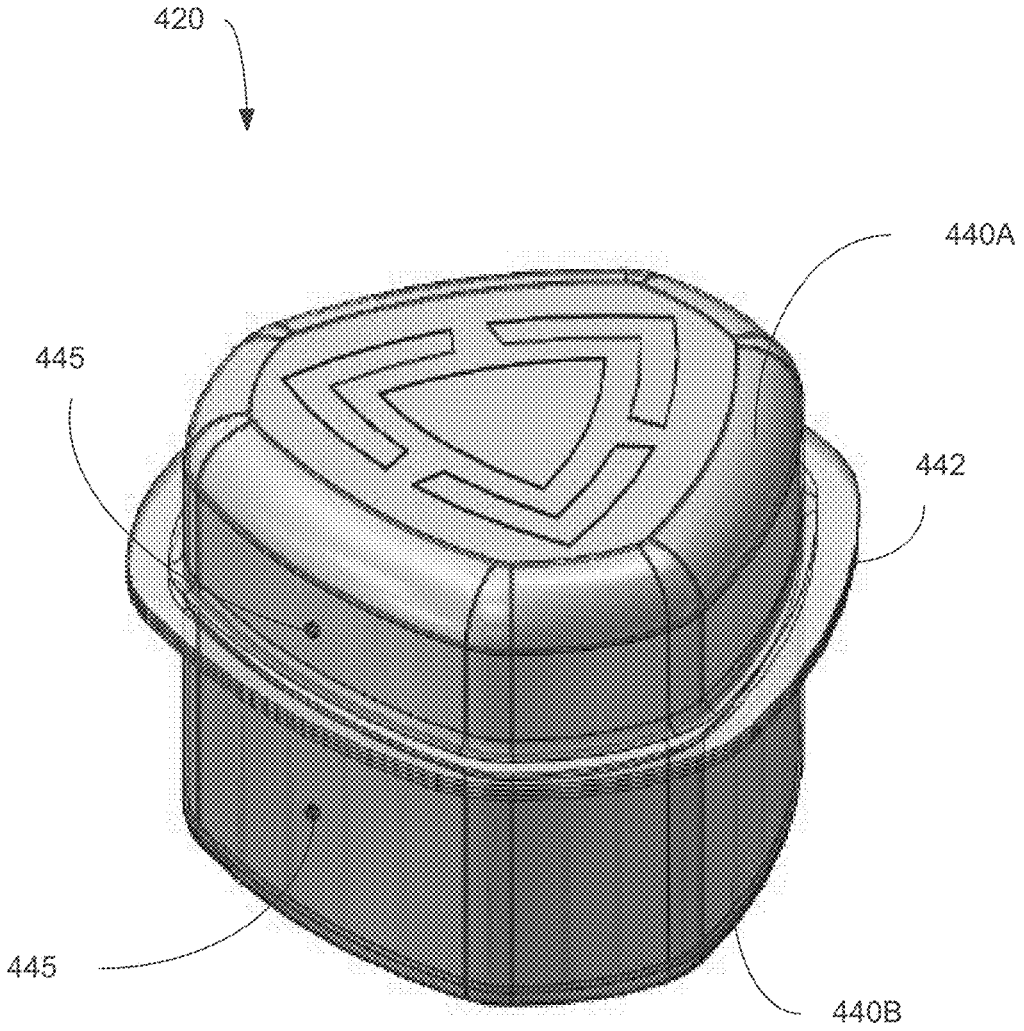
FIG. 4C is a front isometric view of the impact absorbing pad illustrated in FIGS. 4A and 4B.
Figure 4E:
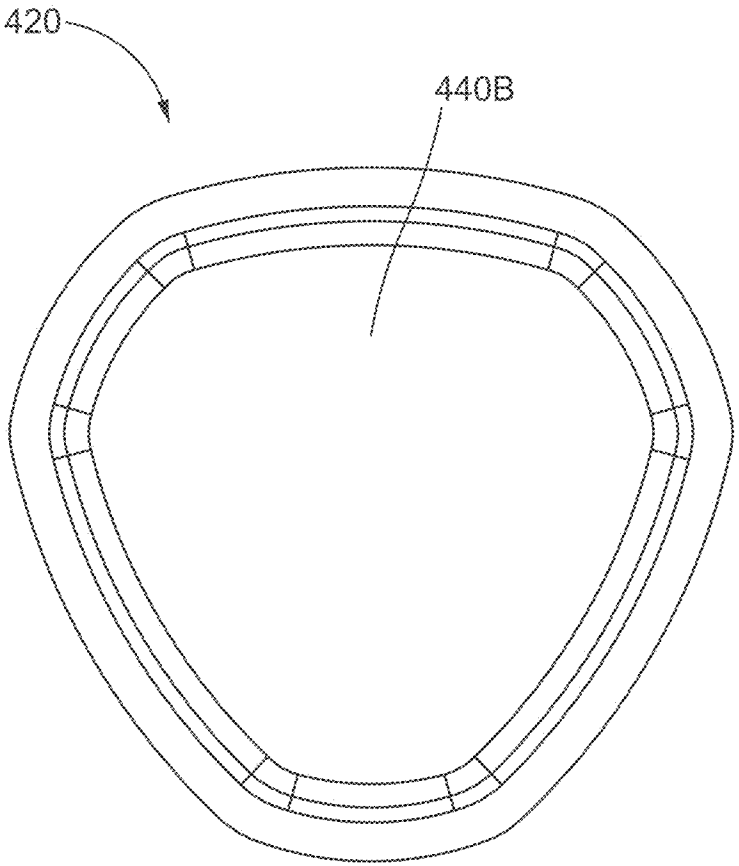
FIG. 4E is a bottom view of the impact absorbing pad illustrated in FIGS. 4A-4D.
Figure 4D:
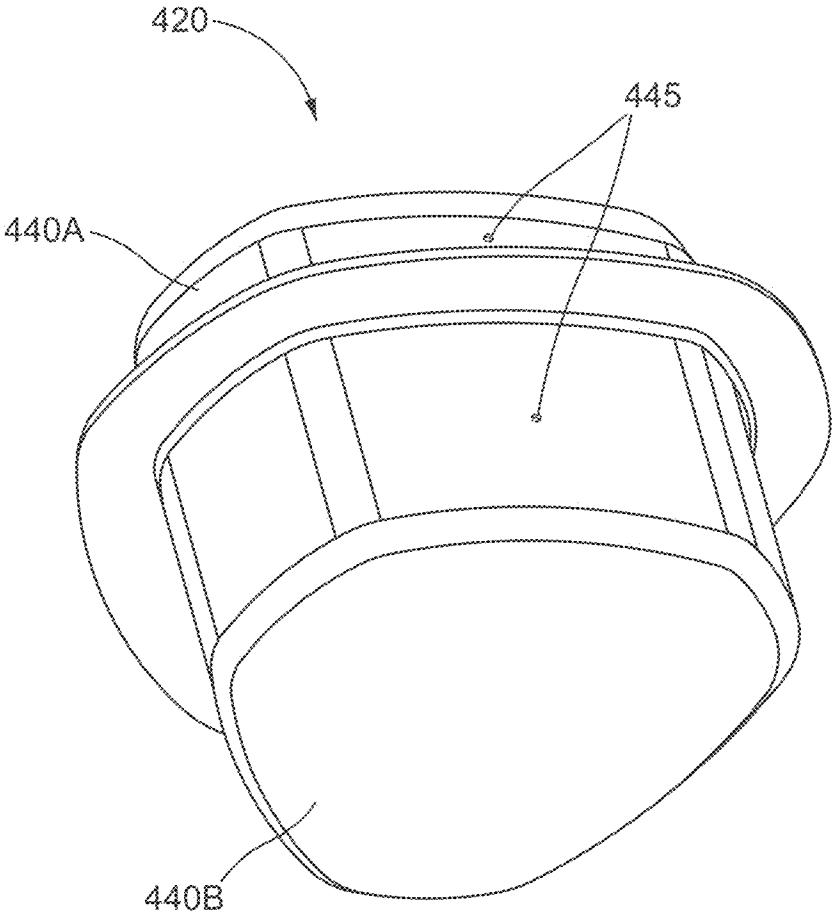
FIG. 4D is a bottom front isometric view of the impact absorbing pad illustrated in FIGS. 4A-4C.
Figure 4G:
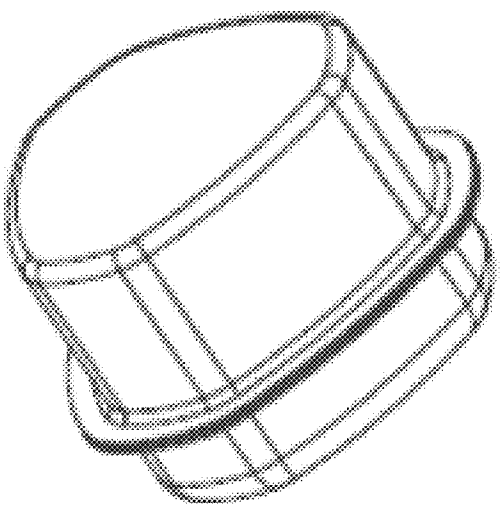
FIG. 4G is a an inverted, rear isometric view of the impact absorbing pad illustrated in FIGS. 4A-4F.
Figure 4H:
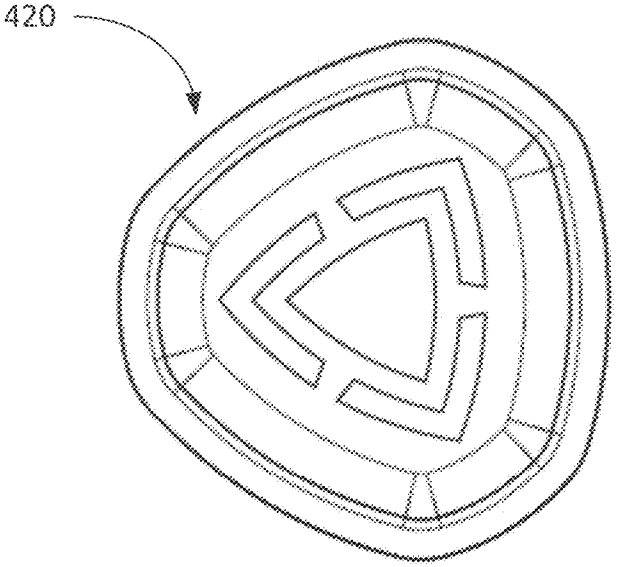
FIG. 4H is a top view of the impact absorbing pad illustrated in FIGS. 4A-4G.
Figure 4F:
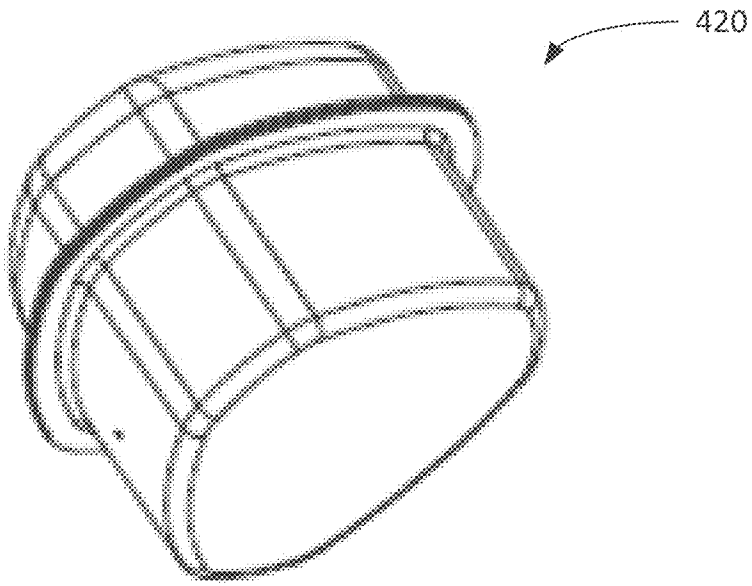
FIG. 4F is a bottom front isometric view of the impact absorbing pad illustrated in FIGS. 4A-4E.
Figure 4J:
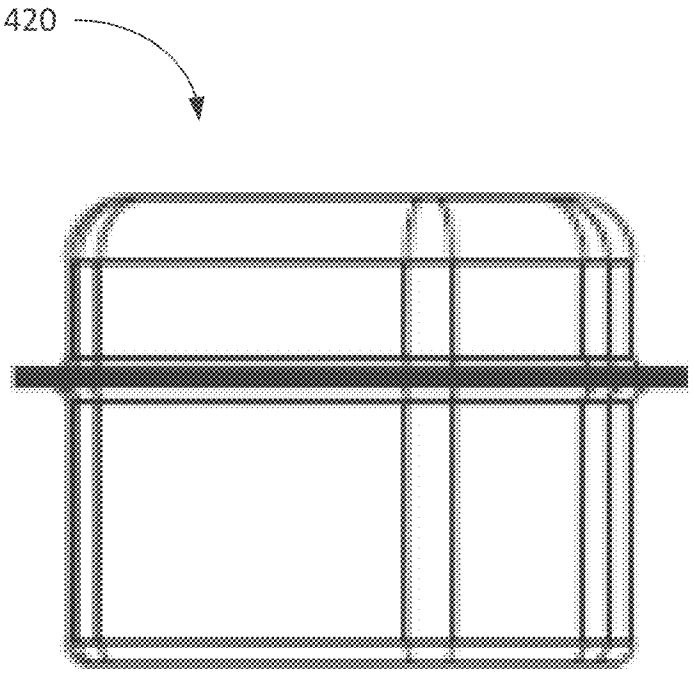
FIG. 4J is a right side view of the impact absorbing pad illustrated in FIGS. 4A-4I.
Figure 4I:
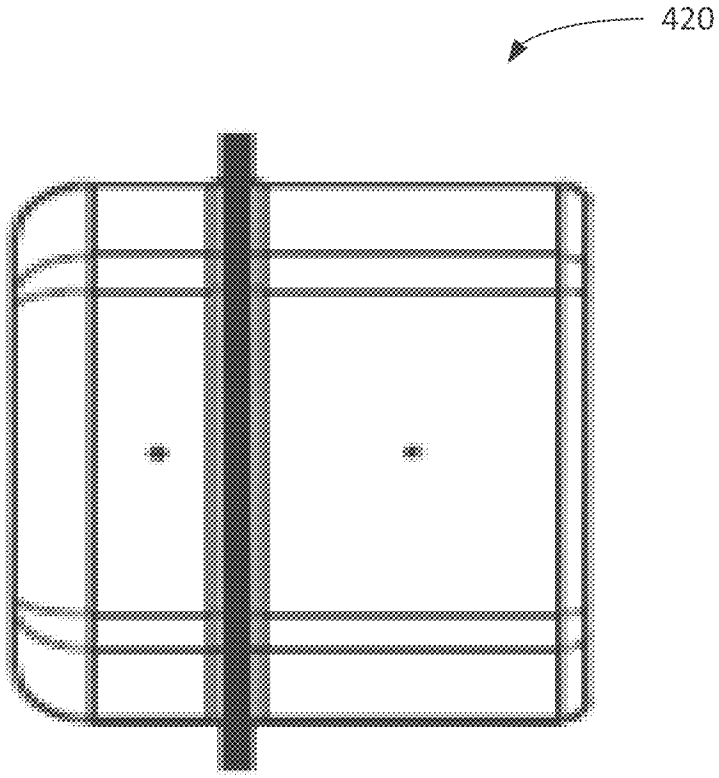
FIG. 4I is a left side view of the impact absorbing pad illustrated in FIGS. 4A-4H.
Figure 7:
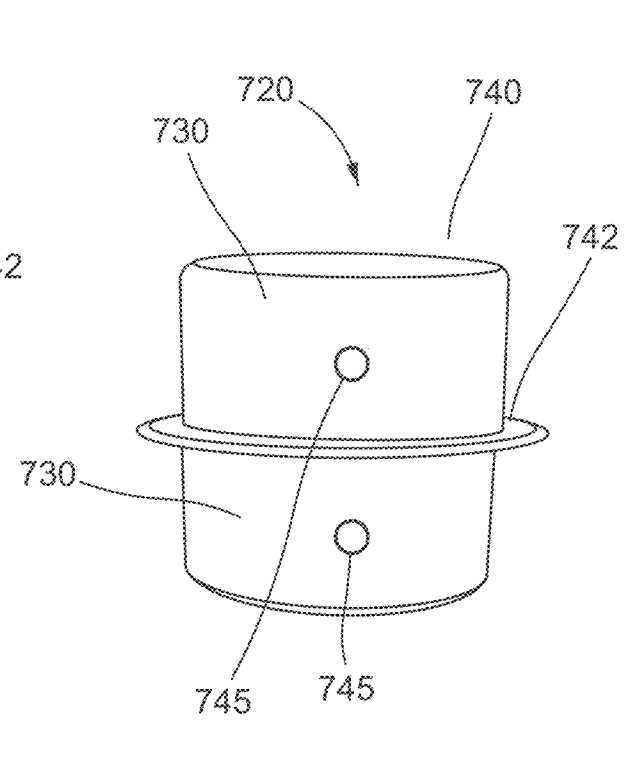
FIGS. 5-7 are impact absorbing pads, according to three embodiments.
Figure 6:
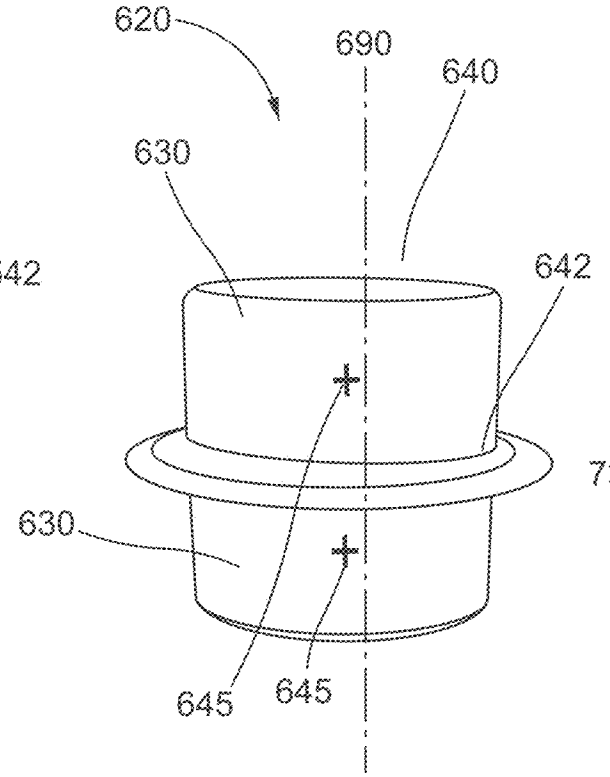
Figure 5:
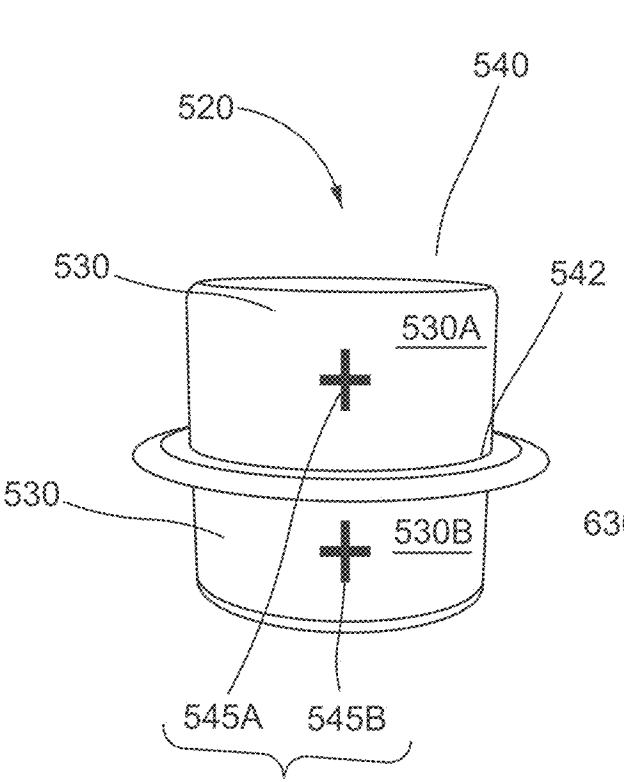

As shown in FIGS. 4A-4J, the pad 420 includes two foam discs 430, a top pad membrane 440A and a bottom pad membrane 440B. FIGS. 4A and 4B are exploded views of pad 420. FIG. 4C is a front isometric view of pad 420. FIG. 4D is a bottom front isometric view of pad 420, and FIG. 4E is a bottom view of pad 420. FIG. 4F is another bottom front isometric view of pad 420. FIG. 4G is an inverted, rear isometric view of pad 420. FIG. 4H is a top view of pad 420. FIG. 4I is a left side view of pad 420. FIG. 4J is a front side view of pad 420.

The top pad membrane 440A and the bottom pad membrane 440B can be operable to be coupled together to define a membrane 440. The pad 420 can also includes a bisecting membrane 442 and two valves 445. The foam members 430, the membrane 440, the bisecting membrane 442, and the valves 445 can be structurally and/or functionally similar to the structural elements 330, the membrane 340, the bisecting membrane 342, and the valves 345, respectively, described above with reference to FIG. 3. Similarly, pad 520, pad 620, and pad 720, shown in FIGS. 5, 6, and 7, respectively, include foam discs 530, 630, and 730, membranes 530, 640, and 740, bisecting membranes 542, 642, and 742, and valves 545, 645 and 745, which can be structurally and/or functionally similar to the structural elements 330, the membrane 340, the bisecting membrane 342, and the valves 345, respectively, described above with reference to FIG. 3.

As shown, the pads 520, 620, and 720 are substantially symmetric. The upper and lower foam discs 530, 630, and 740, are approximately the same shape and size. For example, each of the upper and lower foam discs 530, 630, and 740 can be about 2 inches across in diameter and one inch in thickness. Thus, the pads 520, 620 and 720 about can be about 2 inches across in diameter and two inches in thickness. As shown, the foam discs 530, 630, and 730 are constructed of G25 foam. In other embodiments, the pads 520, 620, and/or 720 can be asymmetric; for example, the foam disc 530A can be G60 foam while the foam disc 530B can be G170 foam. In other embodiments, foam disk/member size, material, shape, etc. can differ or can be asymmetric. Similarly, valves can differ or can be asymmetric. As an example, valves 545A can be a different size and/or shape then valves 545B.

Pad 420 is asymmetric. As shown, the foam member 430A is larger than the bottom foam member 430B. Foam member 430B can be disposed between foam member 430A and a head of a wearer when a helmet containing pad 420 is worn. The pad 420 can be configured to partially deform when the helmet containing pad 420 is worn. Foam member 430B can be configured to deform more than foam member 430A when the helmet containing pad 420 is worn. In some embodiments, foam member 430A can be undeformed or substantially undeformed when the helmet containing pad 420 is worn. For example, foam member 430B can be "softer" than foam member 430A. Similarly stated, foam member 430B can have a lower elastic modulus, can be configured to exert a lower reaction force when the force is applied (e.g., foam member 430B can have a greater indentation force deflection), and/or can have a lower density than foam member 430A.

Such a deformation of foam member 430B can allow the helmet to fit snuggly on the head of the wearer and/or can increase the comfort of the helmet as compared to, for example, a helmet having a single foam member and/or foam members of similar "hardness." Furthermore, the "softer" foam member 430B can be configured to mitigate relatively lower energy impacts than the "harder" foam member 430A. As described above, the combination of two foam members having different impact absorbing characteristics can synergistically mitigate a wider range of impacts than a pad having a single foam member and/or a pad using a single "hardness" foam.

In some embodiments, foam member 430B can be constructed of Wm. T. Burnett & Co. FS170 foam. Foam member 430B can have a density approximately 4.0 to 5.0 $lbf/ft^3$ (or any other suitable density). Foam member 430B can have an indentation force deflection for 25% deflection (i.e., the pressure to compress the foam by 25%) of approximately 150 to 180 lbs/50 $in^2$ (or any other suitable indentation force deflection). In some embodiments, foam member 430A can be constructed of Wm. T. Burnett & Co. G430 foam. Foam member 430A can have a density approximately 4.0 to 4.8 $lbf/ft^3$ (or any other suitable density). Foam member 430A can have a 25% an indentation force deflection for 25% deflection of approximately 225 to 235 lbs/50 $in^2$ (or any other suitable indention force deflection).

Figure 8B:
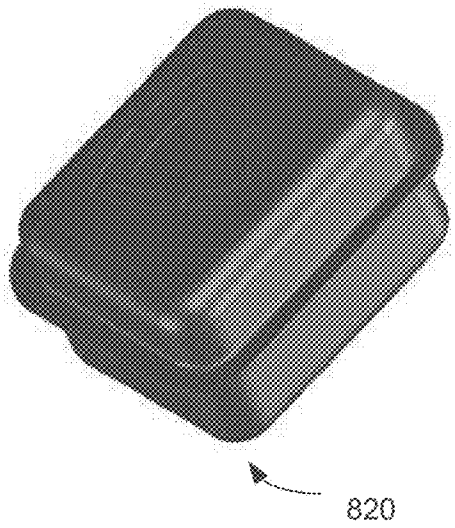
FIG. 8B is an isometric view of the impact absorbing pad illustrated in FIG. 8A.
Figure 8A:
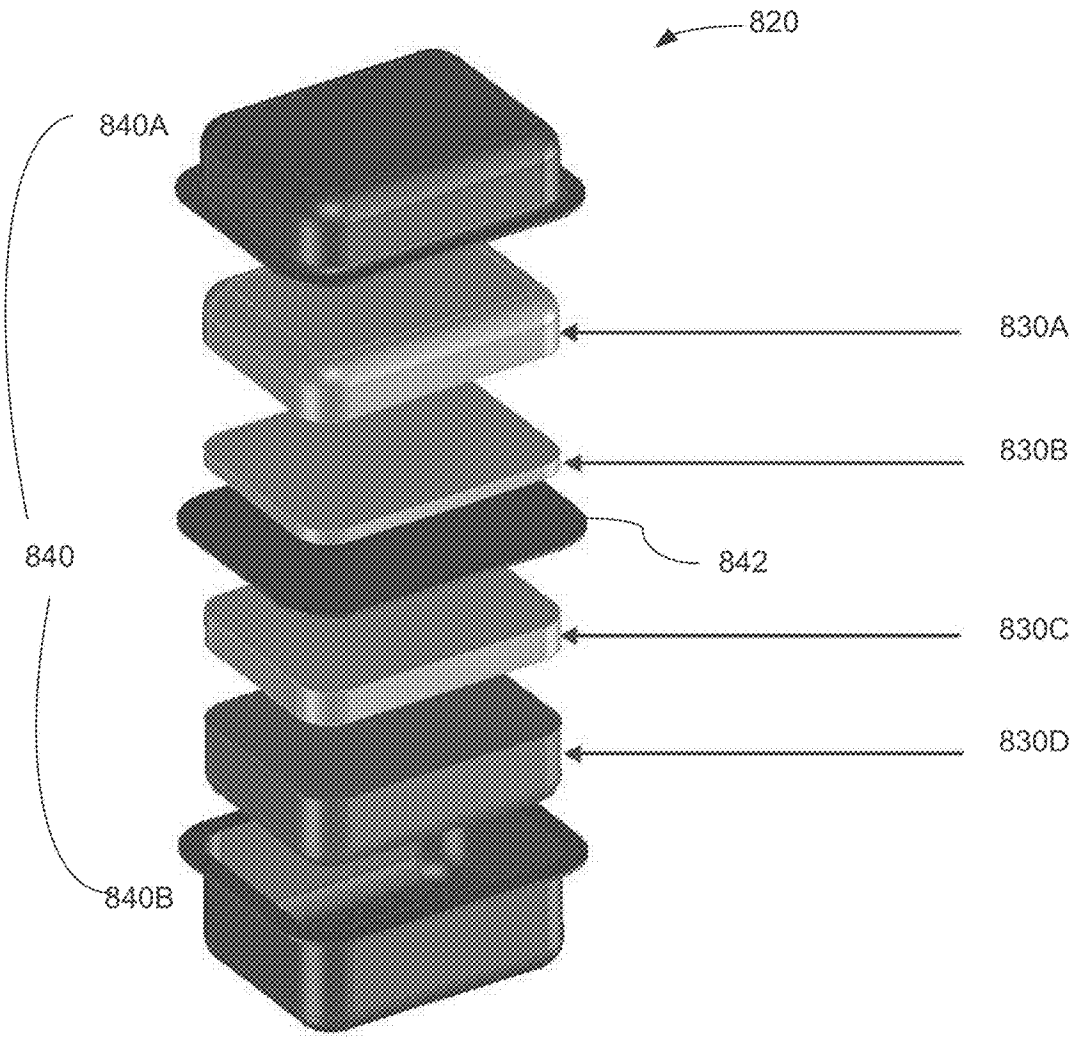
FIG. 8A is an exploded view of an impact absorbing pad, according to an embodiment.

Pad 820, an exploded view of which is shown in FIG. 8A and an isometric view of which is shown in FIG. 8B, includes a top pad membrane 840A and a bottom pad membrane 840B. The top pad membrane 840A and the bottom bad membrane 840B can be operable to be coupled to together to define a membrane 840. The pad 820 also includes a bisecting membrane 842. The pad further includes four structural members, 830A, 830B, 830C, and 830D. In some embodiments, each of the structural members 830A, 830B, 830C, and 830D is substantially rectangular and has a width of approximately 1.9 inches and a depth of approximately 2.5 inches. The first structural member 830A can be constructed of Wm. T. Burnett & Co. FS-170 having a thickness of approximately 0.5 inches. The first structural member 830A can be the structural member configured to be closest to the head of the wearer when a helmet containing the pad 820 is worn. The second structural member 830B can be constructed of XRD-1550035 having a thickness of approximately 0.125 inches. The third structural member 830C can be constructed of XRD-1550035 having a thickness of approximately 0.25 inches. The fourth structural member 830D can be constructed of R-Lite T1515 Hypurcell having a thickness of approximately 0.75 inches. The fourth structural member 830D can be configured to be disposed closest to the shell of the helmet containing pad 820 when the helmet is worn. As described in further detail herein, the pad 820 can be configured to be coupled to a forehead portion of a helmet.

As shown, the pads 420, 520, 620, 720, and 820 are configured to be compressed along the axis of the foam members and/or disks, e.g., axis 690. Similarly stated, the upper and lower chambers are configured to be compressed in series. The valves 454, 545, 645, and 745 are disposed substantially orthogonally to the axis of compression. In other embodiments, a valve can be disposed substantially parallel to the axis of compression.

The valves 545 are approximately 2.5 by 2.5 mm cruciforms cut through the membrane 540. The valves 545 allow air to flow from the interior volumes containing the foam discs 530 when the pad is deformed. Similarly, the valves 645 are approximately 1.0 by 1.0 mm cruciforms cut through the membrane 640. The size of the valves 545 and 645 affects the rate at which air can flow from the interior of the pads 520 and 620 when deformed. The smaller valves 645 of FIG. 5 can provide greater resistance to the flow of air than the larger valves 545 of FIG. 4. In this way, pad 620 can be more effective at absorbing lower accelerations, while pad 520 can be more effective at absorbing higher accelerations.

Each of the valves 745 of pad 720 is an approximately 0.8 mm circular hole in the membrane 740. The circular hole of valve 745 can allow the pad 720 to refill more quickly and provide similar acceleration mitigating performance to the valves 545. By providing faster refill performance, the time between effectively mitigated impacts can be shorter for pad 720 than for pad 520. In other embodiments any other valve geometry and/or size can be chosen to mitigate particular impacts. For example, the valves can be, for example 0.5-10 mm cruciforms and/or 0.5-10 mm circular holes. Although as shown each pad has one valve per chamber, any number of valves can be incorporated into a pad as appropriate for the forces and/or accelerations expected during use of that pad.

Figure 9:
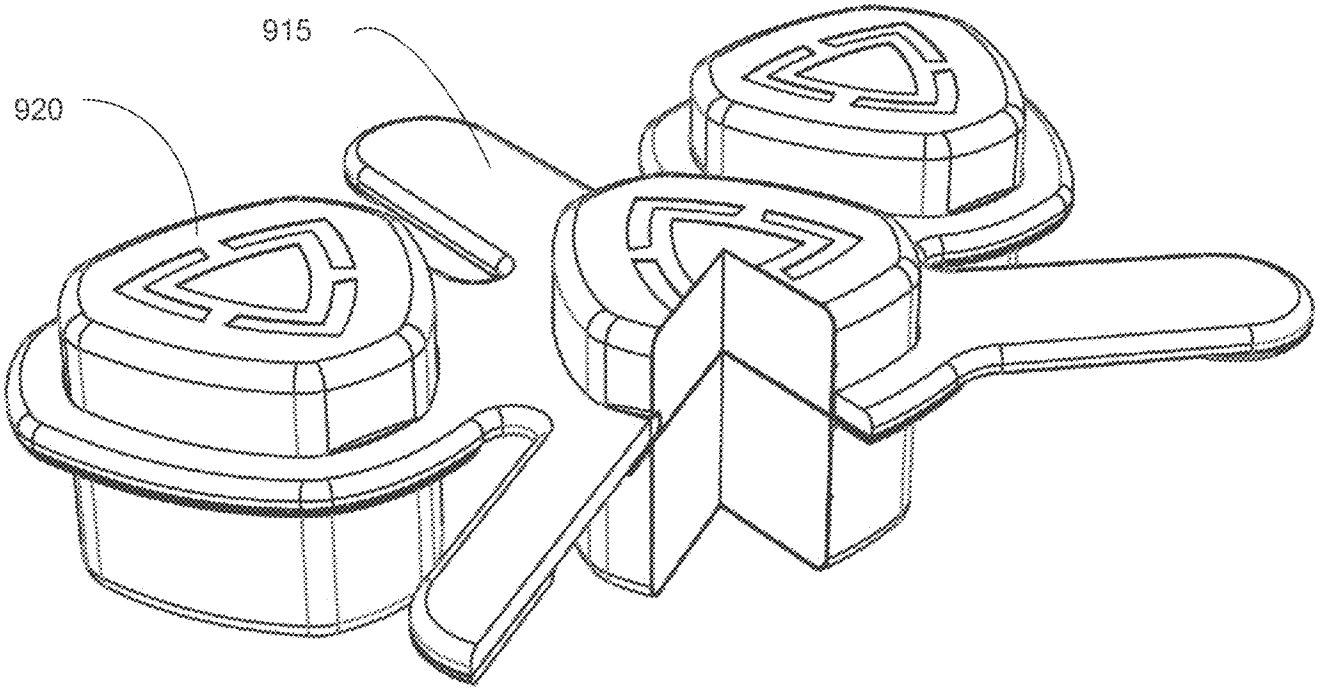
FIG. 9 is an isometric view of pads and a suspension chassis, according to an embodiment.
Figure 10:
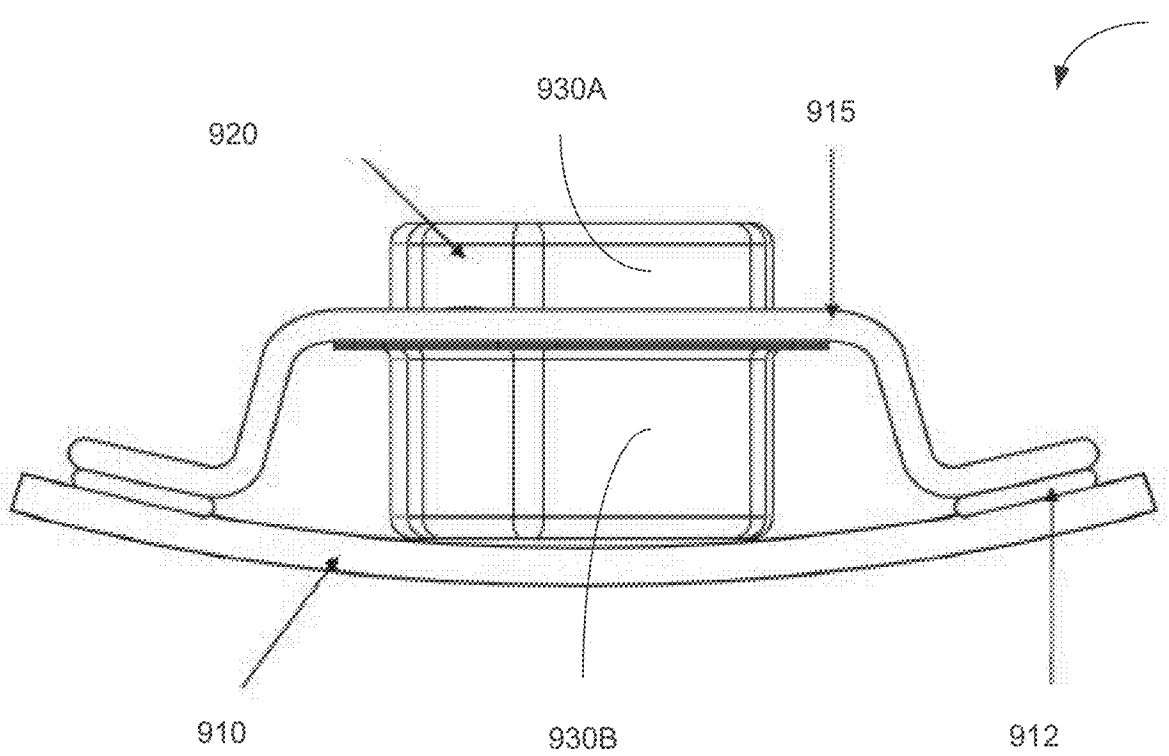
FIG. 10 is a side cross-sectional view of a pad, a suspension chassis, and a shell, according to an embodiment.

FIG. 9 is an isometric view of pads 920 and a suspension chassis 915, according to an embodiment. FIG. 10 is a side cross-sectional view of the suspension chassis 915 and a pad 920 of FIG. 9 coupled to a shell 910 of a helmet 900. The suspension chassis 915 can be coupled to several pads 920. The pads 920 can be structurally and/or functionally to the pads 420, 520, 620, 720, and/or 820 as described with respect to FIGS. 4A-8B.

The suspension chassis 915 can be operable to maintain the position of the pads 920 relative to each other, the shell 910, and/or the head, for example, in a configuration or position to protect a user's head. As shown, the suspension chassis 915 is configured to hold the pads 920 such that one chamber of the pad is configured to contact the head of the user, and the other chamber of the pad is configured to contact the shell of a helmet.

The suspension chassis 915 can be constructed from EVA, nylon, cloth, natural and/or synthetic leather, and/or any other suitable material. In some embodiments, multiple suspension chassis, each containing one or more pads 920 can be coupled to the shell. The suspension chassis 915 can be coupled to the shell via projections, and/or tabs operable to be received by slots and/or grooves of the helmet. Straps and/or ties can also be coupled to the suspension chassis 915 and used to couple the suspension chassis 915 to the shell 910. The suspension chassis 915 can be fixedly and/or removeably coupled to the shell 910. For example, the suspension chassis 915 can be coupled to the shell 910 via a connector 912, such as, for example, snaps, rivets, glue, or any other suitable means such that the suspension chassis 915 cannot move relative to the shell. In some such embodiments, the pads 920 can be coupled to the shell 910 only via the suspension chassis 915. In some embodiments, the suspension chassis 915 can be operable to flex, bend, stretch and/or otherwise enable the pads 910 to move a limited distance relative to the shell 910. For example, as shown, the suspension chassis 915 is coupled to a middle portion of the pads 920 (and not in direct contact with the top surface or bottom surface of the pads 920) such that the end (or top surface) of the pads 920 that are in contact with the shell 910 are not directly coupled to the shell 910. In this way, the end (or top) surface of the pads 920 contacting the shell 910 can move relative to the shell 910. Furthermore, coupling the pads 920 about the middle portion (e.g., between the top surface and bottom surface of the pad 920) can reduce or eliminate the potential tendency of the pads 920 to buckle or bend over when a force is applied (which may result in a side or side surface of a pad 920 contacting the head of the user rather than the bottom surface).

In other embodiments, the suspension chassis 915 can be moveably coupled to the shell 910. For example, the suspension chassis 915 can be placed within the shell 910 such that the suspension chassis 915 maintains the same general position by a friction fit between the suspension chassis 915 and/or the pads 920 and the shell 910. In such embodiments, the suspension chassis 915 can be operable to move relative to the shell 910, for example, when the helmet 900 receives an impact. Such relative movement, can reduce rotational acceleration of the user's head and thereby reduce the risk of injury. In some embodiments, the suspension chassis 915 can be removeably coupled to the shell 910.

The suspension chassis 915 can be configured to locate the pads 920 adjacent to the user's head. For example, when the helmet 900 is placed on the user's head, the pads 920 can be snug against both the user's head and the shell 910 (e.g., the pads 920 can experience a small amount of deformation). In this way, the pads 920 can form a friction fit between the user's head and the shell 910. Thus, the helmet 900 can be oriented and/or maintain its location on the user's head during use.

The pad 920 has a top foam disk 930A and a bottom foam disk 930B. The top foam disk 930A has a height that is shorter than a height of the bottom foam disk 930B. The top foam disk 930A can be configured to be in contact the user's head. In some embodiments, the top foam disk 930A can be less dense and/or have a lower resistance to compression than the bottom foam disk 930B. Similarly, a valve disposed on the top of the pad 920 can be larger than a valve disposed on the bottom of the pad, as described with reference to FIGS. 4-8. In some embodiments, the top of the pad 920 can be more easily compressed than the bottom of the pad 920, which can increase the comfort of the user, for example, when the helmet 900 is placed on the user's head.

The suspension chassis 915 can be configured to position the pads 920 such that the shell 910 can distribute an impact to one or more pads 920. For example, the suspension chassis 915 can be configured to space the pads 920 such that impacts from various angles can be mitigated or absorbed. In some embodiments, impacts from multiple angles occurring simultaneously and/or in close temporal proximity can be absorbed. For example, the helmet 900 can be operable to absorb the forces and accelerations transmitted to a user wearing the helmet 900, playing football, and/or colliding with more than one player at the same and/or different angles. Similarly, if the user collides with the ground shortly after experiencing such collisions, the associated impact can be absorbed by a different pad 920 and/or the pads 920 that absorbed the previous impacts can have returned to their original configurations.

Figure 12:
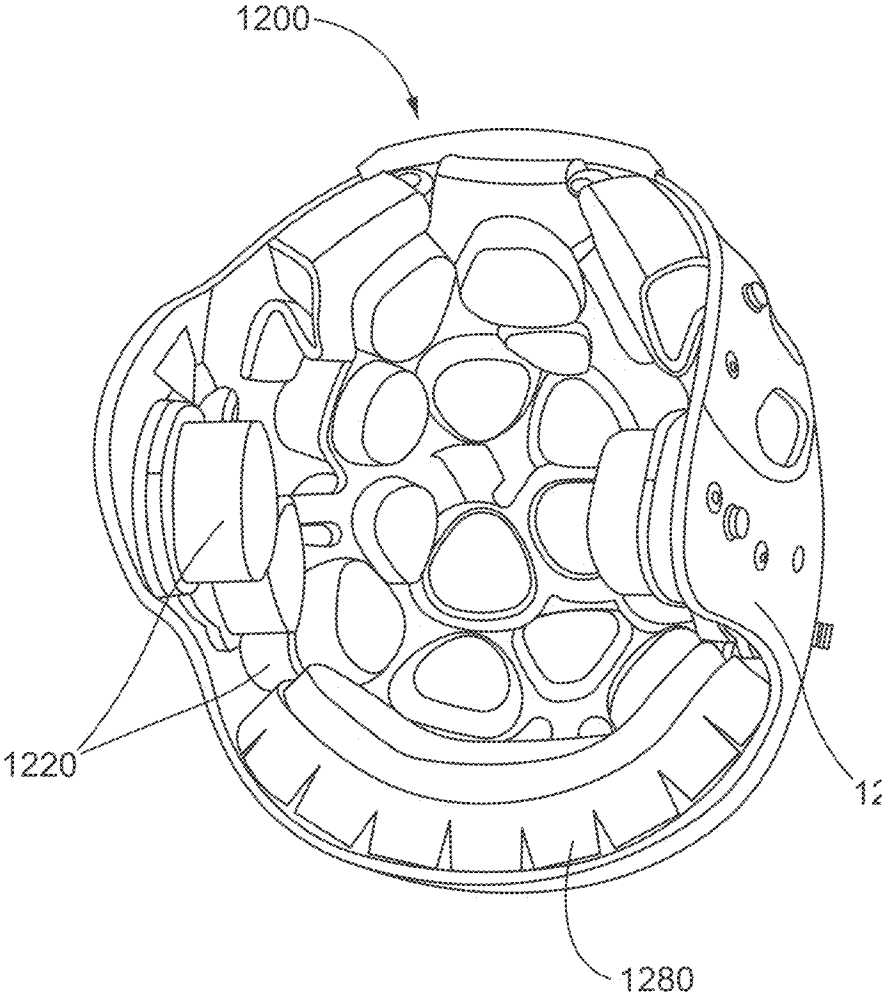
FIGS. 11 and 12 are views of helmets, according to two embodiments.
Figure 11:
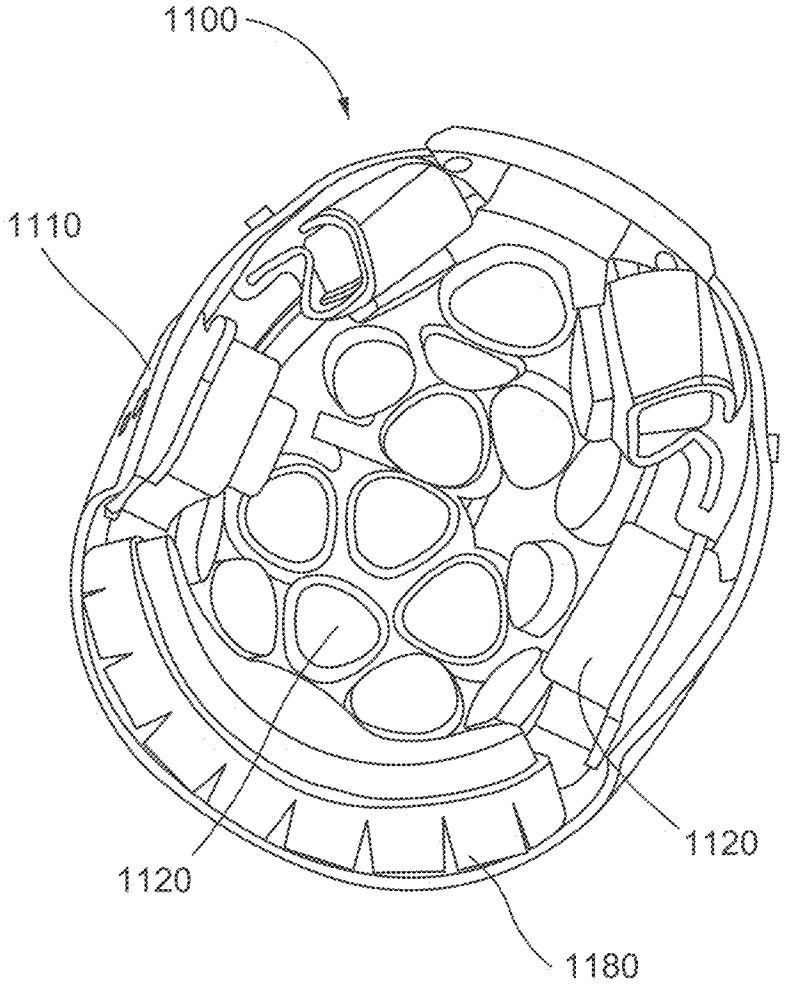

FIGS. 11 and 12 are views of helmets 1100, 1210, respectively. Helmet 1100 includes a shell 1110 and pads 1120. Helmet 1210 includes a shell 1210 and pads 1220. The shells 1110, 1210 and pads 1120, 1220 can be structurally and/or functionally similar to any of the shells or pads discussed herein.

Figure 13:
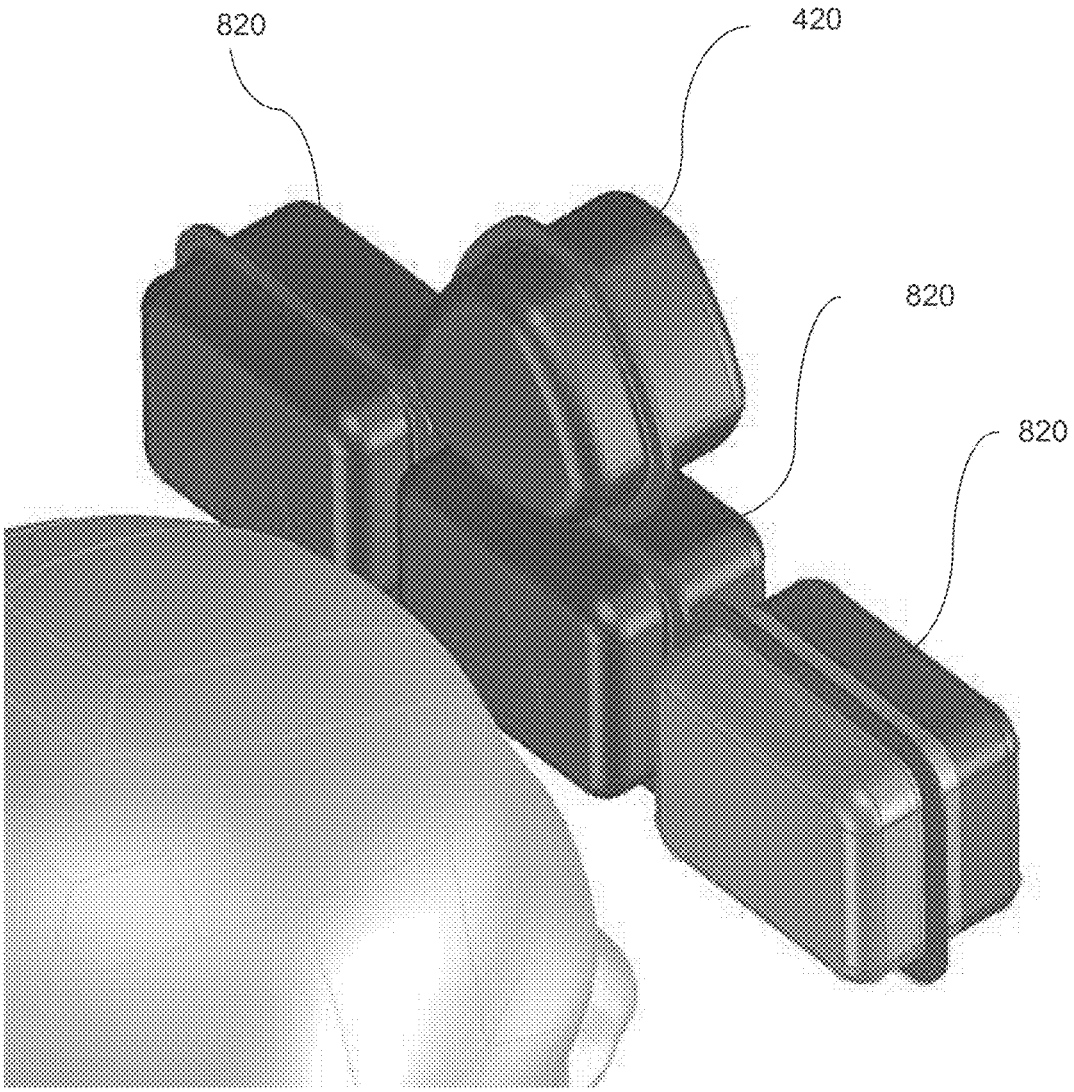
FIG. 13 is view of forehead pads, according to an embodiment.

Helmets 1100 and 1200 also include forehead pads 1180, 1280, respectively. The forehead pads 1180, 1280 are each constructed of two structural members. For example, a first structural member of the forehead pad 1180 and/or 1280 configured to be disposed adjacent to the shell 1110, 1210 can be constructed of Rubberlite HyPur-cel T1515. A second structural member of the forehead pad 1180 and/or 1280 configured to be disposed adjacent to the head of the wearer can be constructed of Poron XRD-09500-65. Although no membrane associated with the forehead pads 1180, 1280 is shown, in some embodiments, the forehead pads 1180, 1280 can include a membrane, a bisecting membrane and/or a valve similar to any of the membranes, bisecting membranes, and/or valves discussed herein. For example, as shown in FIG. 13, three pads 820 (shown and described above with reference to FIGS. 8A and 8B, and a pad 420 can be disposed adjacent to and/or contacting a forehead of a wearer when a helmet 1100, 1200, is worn. Similarly stated, the forehead pad 1180, 1120 shown in FIGS. 11 and 12 can be replaced by previously described pads 820 and/or 420.

The shells 1110, 1210 can be configured to disposed about a portion of a user's head. The shells 1110, 1210 can be partially spherical and operable to sustain impacts from several directions. The shells 1110, 1210 can be substantially rigid and configured to experience relatively little deformation and/or deflection upon receiving an impact. The shells 1110, 1210 can, in some embodiments, be configured to sustain multiple impacts without substantially deforming, cracking, and/or otherwise sustaining damage. The shells 1110, 1210 can be, for example, the polycarbonate shell of a football helmet, or any other suitable outer shell for head protection.

The shells 1110, 1210 can be operable to distribute an impact to one or more of the pads 1120, 1220. As an example, the shell 1110 can receive an impact in an area not immediately adjacent to a pad 1120. Because the shell 1110 can be configured to experience little deformation, the shell 1120 can spread the forces and/or accelerations associated with the impact to nearby pads 1120.

The helmets 1100, 1200 can be configured to mitigate or absorb multiple impacts from multiple angles. Because the shells 1110, 1210 can be configured to substantially enclose a user's head, and the pads 1120, 1220 can be distributed around the user's head, the helmets 1100, 1200 can be configured to receive and absorb impacts to, for example, the top of a user's head, the sides of a user's head, the back of a user's head, and so forth. For example, the helmets 1100, 1200 can be configured to mitigate an impact to one side of the helmet (such as the front or top) followed, in relatively rapid succession (e.g., within 0.5 seconds, within 1 second, within 2 seconds, within 30 seconds, etc.) by a second impact to another side of the helmet (such as the back or side). For example, the helmets 1100, 1200 can be suitable to absorb an impact associated with a tackle followed by an impact associated with the user and the helmet hitting the ground. Similarly stated, the helmets 1100, 1200 can be configured to mitigate multiple impacts from multiple directions occurring in relatively rapid succession, for example, through different pads 1120, 1220. In addition, as described in greater detail herein, the same pads 1120, 1220 that mitigate a first impact can recover in a relatively short amount of time to mitigate a second impact.

In some embodiments, pads 1120, 1220 with different impact absorbing characteristics can be placed in different locations in the helmets 1100, 1200. For example, in embodiments where the severity of an impact can be statistically correlated with location for a given application of the helmet 1100, 1200 (e.g. for a particular sport or activity), pads operable to absorb higher energy impacts can be disposed in those regions. For example, pads 1120, 1220 operable to absorb higher energy impacts can be positioned such that they are disposed adjacent to the crown of the user's head. For example, the crown of the helmet may be at risk for receiving relatively higher energy impacts than, for example, the side of the helmet. This may be due to increased number and/or intensity of collisions (such as the wearer "lowering his helmet" to make a hit) and/or higher structural rigidity of the shell 1110, 1210 (which may dissipate less energy) at the crown as compared to the side of the helmet, which may be more flexible and/or be prone to receive fewer and/or lower intensity impacts. Different activities or sports may be associated with different patterns of impact. For example, in hockey, it may be determined that the back of the helmet is prone to relatively high-energy impacts, while in cycling, it may be determined that high-energy impacts to the back of the helmet are improbable. In this way, the location of pads configured to mitigate high-energy impacts and the location of pads configured to mitigate low-energy impacts can be optimized. In the previous example, a hockey helmet can be constructed having relatively "hard" pads in the back of the helmet and relatively "soft" pads on the crown, while a cycling helmet can be constructed having relatively "hard" pads on the crown and/or sides and relatively "soft" pads in the back.

Returning to the helmets 1100, 1200, a first pad associated with (e.g., disposed adjacent to, coupled to, and/or configured to mitigate impacts to) a first portion of the shell 1110, 1210, such as the crown, but not associated with (e.g., disposed adjacent to, coupled to, and/or configured to mitigate impacts to) a second portion of the shell 1110, 1210, such as the side, can be preselected to mitigate higher energy impacts than a second pad associated with the second portion of the shell but not the first portion of the shell. For example, by having a "harder" structural member and/or a smaller valve, the first pad can absorb a greater amount of energy associated with a relatively high-energy impact (e.g., an impact associated with a relatively high force) than the second pad. For example, a pad 1120, 1220 disposed adjacent the crown of the user's head can include a first structural member constructed of Rubber-lite hypur-cell T1515 and a second structural member constructed of FS 170, while the pads disposed adjacent the side of the head (such as near the jaw) can include two structural members each constructed of G430. The structural members of the pads disposed adjacent the side of the head can have similar or different thicknesses. In this way, the wearer's head can experience a smaller acceleration when the first portion (e.g., the crown) of the shell receives a relatively high-energy impact as compared to when the second portion (e.g. the side) of the shell receives the relatively high-intensity impact. Similarly, by having a "softer" structural member and/or a larger valve, the second pad can absorb a greater amount of energy associated with a relatively low-energy impact (e.g., an impact associated with a relatively low force) than the first pad. In this way, the wearer's head can experience a smaller acceleration when the second portion of the shell receives a relatively low-energy impact as compared to when the first portion of the shell receives the relatively low-energy impact. This can be beneficial if, for example, relatively high-energy impacts are probable for the first portion (e.g., the crown) of the shell, but relatively improbable for the second portion (e.g., the side).

The helmets 1100, 1200 can also be configured to absorb the effects of multiple impacts occurring in relatively rapid succession. For example, as discussed above with reference to FIGS. 4-8, the pads 1120, 1220 can be configured to return to their original configuration in a relatively short period of time. Because the pads 1120, 1220 can return to their original configuration, and because the shell 1110, 1210 can be resilient, the helmet 1100, 1200 can absorb multiple impacts to the same area. For example, the pads 1120, 1220 can be configured to return to their original configuration in an amount of time shorter than the amount of time expected to elapse between impacts. For example, the pads 1120, 1220 can return to their original configuration in less time than is expected to elapse between colliding with an athlete and striking the ground.

Figure 14:
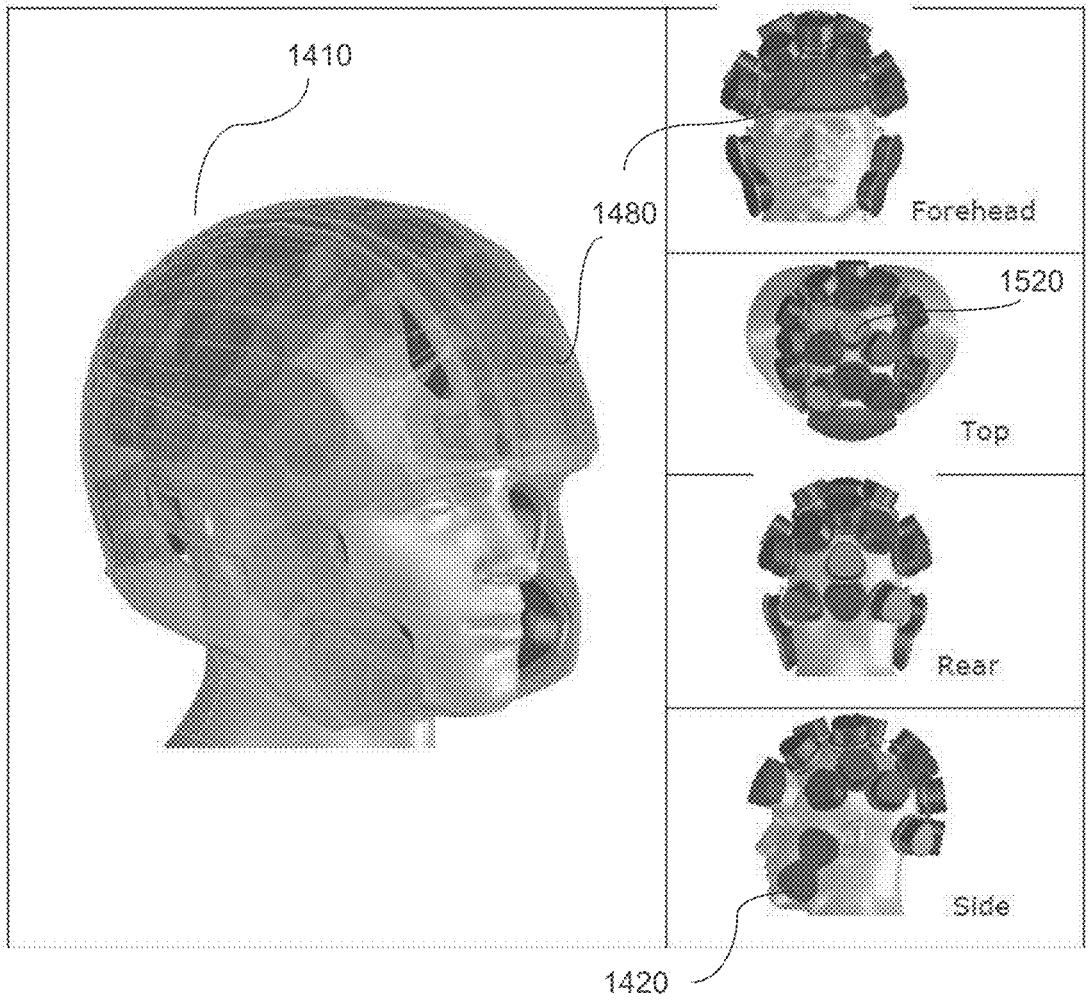
FIGS. 14 and 15 depict an arraignment of pads relative to a helmet shell and a wearer's head.
Figure 15:
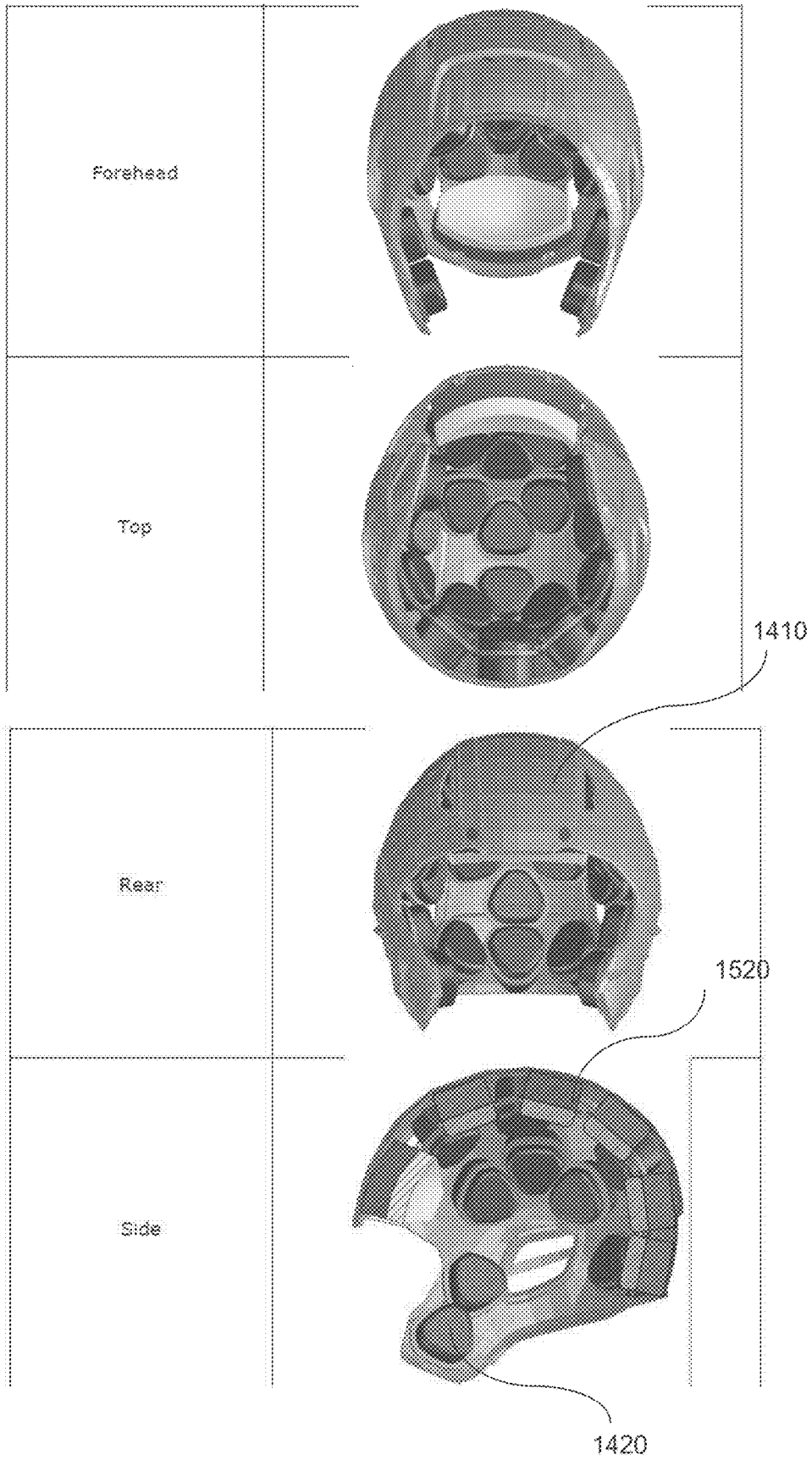
Figure 17:
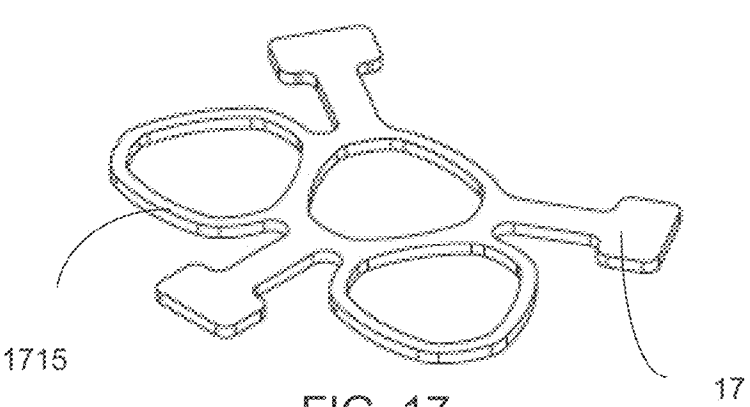
FIGS. 16-19 are isometric views of suspension chassis, according to four embodiments.
Figure 19:
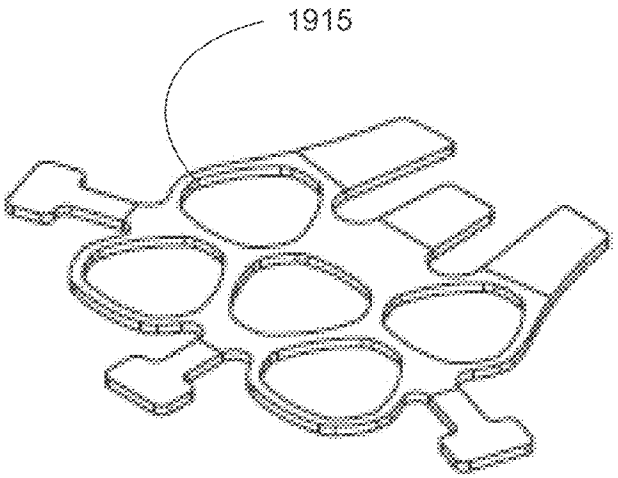
Figure 16:
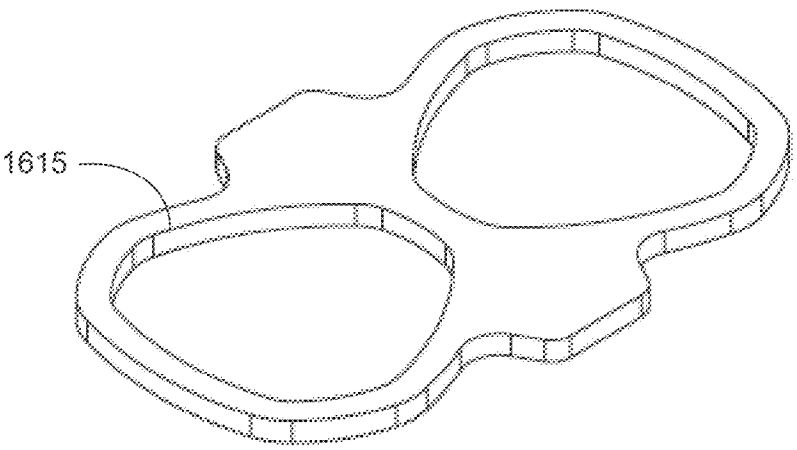
Figure 18:
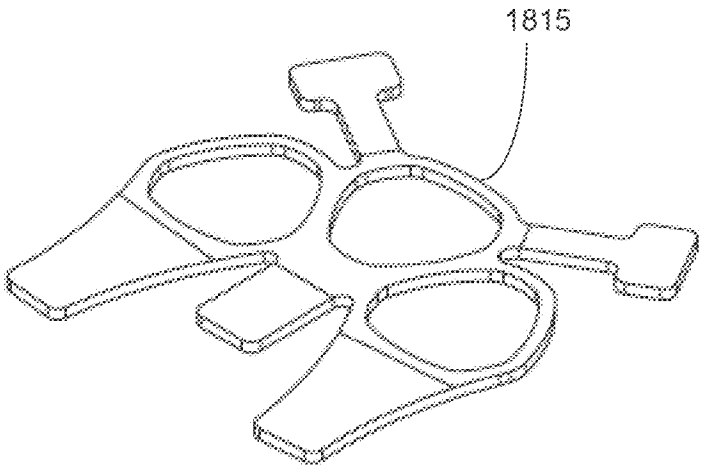

FIGS. 14 and 15 depict an arraignment of pads relative to a helmet shell and a wearer's head. As shown in FIGS. 14 and 15, a total of 23 triangular pads and one forehead pad 1480 are disposed within an interior of a helmet shell 1410. FIG. 14 depicts the pads in relationship to a head of a wearer. FIG. 14 includes an isometric view of a head and a helmet with a partially transparent shell 1410, as well as a forehead view, a top view, a rear view, and a side view of a head including the location of the pads (without the shell 1410 shown for purposes of clarity). FIG. 15 depicts a forehead view, a top view, a rear view, and side view depicting the pads relative to the shell 1410. The triangular pads can be coupled to the helmet shell 1410 via one or more suspension chassis, such as the suspension chassis described in further detail herein with reference to FIGS. 16-19.

As described herein, in some embodiments, a crown pad 1520 can be "harder" than other triangular pads disposed within the helmet. In addition, jaw pads 1420 can be "softer" than other triangular pads disposed within the helmet. The forehead pad 1480 can be similar to the forehead pad 1280 as shown and described above with reference to FIG. 12.

FIGS. 16-19 are isometric views of suspension chassis, according to various embodiments. The chassis 1615 can hold two pads, the chassis 1715 and 1815 can hold three pads, and the chassis 1915 can hold five pads. In other embodiments, a chassis can hold any number of pads. In some embodiments multiple chassis, including chassis having different sizes and/or configurations, can be disposed within a shell of a helmet. Chassis having different configurations can be used, for example, in different areas of a helmet so that pads can be a disposed in different patterns. For example, one chassis can be configured to position pads relatively close together, while another chassis can be configured to space pads more widely. Thus, in some embodiments, the selection of different chassis can allow the relative density of pads to be adjusted, for example, a chassis can be selected to space pads differently in different portions of the helmet, or interchangeable chassis can be used to select the number of pads for a particular activity.

The chassis 1615, 1715, 1815, and/or 1915 can structurally and/or functionally similar to the chassis 915, as shown and described above. For example, the suspension chassis 1615, 1715, 1815, and/or 1915 can be coupled to a shell of a helmet via a connector, such as, for example, snaps, rivets, glue, or any other suitable means such that the suspension chassis 1615, 1715, 1815, and/or 1915 cannot move relative to the shell.

The chassis can include projections, e.g. the projection 1717, that can be operable to couple the chassis to a shell of a helmet. For example, the projection 1717 can be operable to be disposed in a slot or groove of the shell, and/or can include a fastener, such as a snap and/or a hook-and-loop fastener, such that the chassis can be coupled to the shell of the helmet. Chassis having different shapes can be operable to be disposed in different areas of the helmet. For example a relatively small chassis, such as chassis 1615 can be configured to be disposed near an ear or cheek portion of the helmet, while a relatively large chassis, e.g., chassis 1915, can be configured to be disposed near the top of a helmet.

In some embodiments, the helmets and/or pads described herein can operate to mitigate impacts via two or more modes operating synergistically. As a first example, a pad including a structural member and a membrane can operate to mitigate an impact via deformation of the structural member as well as via restriction of flow exiting an interior volume defined by the membrane as the pad is deformed. In this way, such a pad can use a "softer" structural member than a pad devoid of a membrane (i.e., exposed foam). The use of the "softer" structural member can more efficiently mitigate relatively low-energy impacts. Performance mitigating relatively high-energy impacts is not sacrificed, as would traditionally be the case using a "soft" structural member, by disposing the structural member within an interior region of membrane. By restricting the flow of air out of the interior region, the rate of deformation of the pad can be constrained, such that the air pressure within the interior region operates as a second mode of dissipating impact energy. Thus, the pad can appear "hard" to a relatively high-energy impact and "soft" to a relatively low-energy impact.

As a second example, a pad can include multiple structural members. The structural members can be stacked such that they each contribute to mitigate an impact. In some such embodiments, the structural members can be constructed of different materials, such that one structural member is more effective at mitigating relatively higher energy impacts (e.g., it is "harder") while the other structural member is more effective at mitigating relatively lower energy impacts (e.g., it is "softer"). Thus, such a pad can be operable to mitigate a relatively low-energy impact in a first mode primarily through deformation of the "softer" pad and operable to mitigate a relatively high-energy impact primarily through deformation of the "harder" pad. Such a pad can be further include a membrane surrounding the structural members and/or each structural member can be disposed within an interior region of the pad to provide further synergistic impact mitigation capability.

As a third example, since pads can be optimized, designed, and/or selected to mitigate different levels of impact (e.g., by selecting the "hardness" of the structural member(s) and/or by altering resistance to flow of a fluid from an interior region of a membrane), a helmet can be constructed with pads having different impact absorbing characteristics associated with (e.g., coupled to, disposed adjacent to, etc.) different portions of the helmet shell. In this way, a helmet can be designed for a specific activity or sport based on the type of impacts and impact locations associated with the activity or sport. Furthermore, different areas of helmet shells can have different degrees of structural rigidity, which can alter impact transmission characteristics. In some embodiments, a relatively "harder" pad can be associated with relatively rigid portions of the helmet shell (such as the crown), while relatively "soft" pads can be associated with relatively flexible portions of the helmet shell since shell flexion can be operable to mitigate a portion of the impact. Alternatively, "harder" pads can be disposed adjacent to less structurally rigid portions of a helmet shell if relatively high-energy impacts are probable in that area of the shell.

As a fourth example, a helmet containing pads containing structural members and membranes can be operable to mitigate repeated impacts from a variety of directions. Similarly stated, the helmets described herein can be suitable to receive an impact from a first direction (and/or to a first area of the helmet) followed in relatively rapid succession by a second impact from a second direction (and/or to a second area of the helmet). The pads can be configured to recover within the time between impacts and/or different pads can be configured to mitigate subsequent impacts. In some embodiments, one structural member of a pad can be configured to mitigate a first impact and a second structural member can be configured to mitigate a second impact occurring in relatively rapid succession.

While various embodiments have been described above, it should be understood that they have been presented by way of example only, and not limitation. For example, although some embodiments describe a pad configured to be placed in a football helmet, other embodiments where the pad is a hockey helmet, a cycling helmet, a lacrosse helmet, a baseball helmet, and/or any other suitable helmet are possible. Furthermore, in other embodiments, a pad can be placed in any other structure designed to absorb impacts, such as automotive bumpers, shipping materials, or other athletic equipment, such as shoulder pads or chest protectors. In other embodiments, such a pad can be incorporated into a barrier, such as athletic boundaries, e.g., hockey boards and/or goal posts.

Although various embodiments have been described as having particular features and/or combinations of components, other embodiments are possible having a combination of any features and/or components from any of embodiments where appropriate. For example, although some embodiments are described as having a pad disposed within a protective shell, in other embodiments, the protective pad can be disposed between two protective shells. Similarly, although some embodiments are described with one valve configured to release air from an interior volume defined by a membrane, in other embodiments, a valve can be configured to release air from two internal volumes. For example, with reference to FIG. 5, a valve can be disposed between the chamber containing structural element 530A and the chamber containing structural element 530B. As another example, although pads configured to absorb higher energy impacts are described as being placed at the top of the helmet with respect to, for example, FIGS. 14 and 15, in other embodiments, the same pads can be used at all locations, or pads operable to absorb high and/or low-energy impacts can be placed at any location.

As used herein the terms "force(s)," "acceleration(s)," "energy," and/or other terms associated with impacts are used to describe magnitudes and/or relative magnitudes of the impacts. As such, such terms should be considered directionless unless the context clearly indicates otherwise. For example, if a first impact is associated with an acceleration of 5 g in a positive direction and a second impact is associated with an acceleration of 20 g in a negative direction, the second impact is associated with a greater acceleration than the first impact.

What is claimed is:

1. A pad, comprising:

a flexible outer membrane;

a flexible inner membrane, the flexible outer membrane and the flexible inner membrane collectively defining at least two interior volumes;

a first structural member disposed in a first interior volume from the at least two interior volumes and in contact with the flexible inner membrane;

a second structural member disposed in a second interior volume from the at least two interior volumes and in contact with the flexible inner membrane, the first structural member configured to be disposed between the second structural member and a source of an impact; and a valve fluidically coupling (i) at least one of the first interior volume or the second interior volume to (ii) a space exterior to the flexible outer membrane.

2. The pad of claim 1, wherein the first structural member has a first indentation force deflection, and the second structural member has a second indentation force deflection that is less than the first indentation force deflection.

3. The pad of claim 1, wherein the flexible outer membrane and the flexible inner membrane are each constructed of a plastic film having a thickness of less than 1 mm.

4. The pad of claim 1, wherein the flexible outer membrane and the flexible inner membrane are constructed of polyurethane having a thickness of less than 1 mm.

5. The pad of claim 1, wherein the first structural member has a first elastic modulus and the second structural member has a second elastic modulus that is greater than the first elastic modulus of the first structural member.

6. The pad of claim 1, wherein the first structural member and the second structural member are different in shape or size.

7. The pad of claim 1, wherein each of the first structural member and the second structural member has a diameter of 2 inches and a thickness of 2 inches.

8. A pad, comprising:

an outer membrane;

an inner membrane, the outer membrane and the inner membrane collectively and entirely defining a first interior volume and a second interior volume;

a first structural member disposed in the first interior volume such that the first structural member is configured to be in contact with the outer membrane and the inner membrane;

a second structural member disposed in the second interior volume, the inner membrane at least partially separating the first structural member from the second structural member; and a valve fluidly coupling at least one of the first interior volume or the second interior volume with a space exterior to the outer membrane.

9. The pad of claim 8, wherein the second structural member is disposed in the second interior volume such that the second structural member is configured to be in contact with the outer membrane and the inner membrane.

10. The pad of claim 8, wherein the outer membrane and the inner membrane are flexible.

11. The pad of claim 8, wherein the valve places both of the first interior volume and the second interior volume in fluid communication with the space exterior to the outer membrane.

12. The pad of claim 8, wherein the valve is a first valve fluidically coupling the first interior volume with the space exterior to the outer membrane, the pad further comprising:

a second valve fluidically coupling the second interior volume with the space exterior to the outer membrane.

13. The pad of claim 8, wherein the first structural member has a first hardness, and the second structural member has a second hardness greater than the first hardness.

14. The pad of claim 8, wherein the valve is a circular hole in the outer membrane.

15. The pad of claim 8, wherein:

the first structural member and the second structural member have a common axis, and the first structural member and the second structural member are configured to deform in response to a force applied to the pad along the common axis to absorb at least a portion of energy associated with the force.

16. The pad of claim 8, wherein the first structural member configured to be between the second structural member and a source of an impact.

* * * * *